US009301369B2

(12) United States Patent
Yaras

(10) Patent No.: US 9,301,369 B2
(45) Date of Patent: Mar. 29, 2016

(54) DISPLAY APPARATUS UTILIZING INDEPENDENT CONTROL OF LIGHT SOURCES FOR UNIFORM BACKLIGHT OUTPUT

(71) Applicant: Pixtronix, Inc., San Diego, CA (US)

(72) Inventor: Fahri Yaras, Chelsea, MA (US)

(73) Assignee: Pixtronix, Inc., San Diego, CA (US)

( * ) Notice: Subject to any disclaimer, the term of this patent is extended or adjusted under 35 U.S.C. 154(b) by 237 days.

(21) Appl. No.: 13/787,016

(22) Filed: Mar. 6, 2013

(65) Prior Publication Data

US 2014/0253562 A1 Sep. 11, 2014

(51) Int. Cl.

| | |
|---|---|
| ***G09G 3/36*** | (2006.01) |
| ***H05B 37/02*** | (2006.01) |
| ***G09G 5/10*** | (2006.01) |
| *G09G 3/34* | (2006.01) |

(52) U.S. Cl.

CPC ..... *H05B 37/02* (2013.01); *G09G 3/342* (2013.01); *G09G 5/10* (2013.01); *G09G 3/3406* (2013.01); *G09G 2320/0233* (2013.01); *G09G 2320/064* (2013.01); *G09G 2320/0626* (2013.01); *G09G 2320/0633* (2013.01); *G09G 2340/0428* (2013.01)

(58) Field of Classification Search

USPC ..... 345/102, 501; 315/297

See application file for complete search history.

(56) References Cited

U.S. PATENT DOCUMENTS

| | | | | |
|---|---|---|---|---|
| 2008/0180414 | A1 | 7/2008 | Fung et al. | |
| 2009/0066631 | A1 | 3/2009 | Lianza | |
| 2010/0253696 | A1 | 10/2010 | Choi | |
| 2011/0157247 | A1 | 6/2011 | Tanaka et al. | |
| 2011/0175938 | A1* | 7/2011 | Lee | 345/690 |
| 2011/0249034 | A1 | 10/2011 | Nagai | |
| 2012/0313985 | A1 | 12/2012 | Gotoh | |
| 2012/0320105 | A1 | 12/2012 | Ueno et al. | |
| 2013/0015770 | A1* | 1/2013 | Aitken | 315/154 |

FOREIGN PATENT DOCUMENTS

WO 2013012688 A1 1/2013

OTHER PUBLICATIONS

International Search Report and Written Opinion—PCT/US2014/017109—ISA/EPO—May 28, 2014.

Taiwan Search Report—TW103105513—TIPO—Aug. 11, 2015.

* cited by examiner

*Primary Examiner* — Jason Olson

*Assistant Examiner* — Sosina Abebe

(74) *Attorney, Agent, or Firm* — Edward A. Gordon; Foley & Lardner LLP

(57) ABSTRACT

This disclosure provides systems, methods and apparatus for improving light output resolution of a backlight by individually controlling light sources in the backlight. Illumination intensity levels of light sources are individually controlled such that an overall illumination intensity level of all the light sources is substantially equal to a desired whole backlight illumination intensity value. The individual illumination levels of the light sources or a group of the light sources is controlled such that the backlight is uniformly illuminated. In some implementations, the illumination intensity levels are varied over different portions of an illumination period to provide uniform illumination of the backlight.

18 Claims, 16 Drawing Sheets

DISPLAY APPARATUS UTILIZING INDEPENDENT CONTROL OF LIGHT SOURCES FOR UNIFORM BACKLIGHT OUTPUT

TECHNICAL FIELD

This disclosure relates to the field of imaging displays, and in particular to backlight control.

DESCRIPTION OF THE RELATED TECHNOLOGY

Certain display apparatus rely on being able to precisely control the illumination intensity of the light sources they incorporate in order to generate desired display primaries. For example, the chromaticities of the red, green, and blue light emitting diodes (LEDs) often incorporated into displays typically do not match the chromaticities of the primary colors of the color gamuts, such as the Adobe RGB or sRGB color gamuts, they are trying to reproduce. To faithfully reproduce these primary colors, the display must output a precise mix of each of its LEDs. In addition, some displays incorporate content adaptive backlight control (CABC), which also relies upon the display being able to adjust the output intensity of its light sources. Still other displays control the intensity of output intensity of their light sources to take into account differences in ambient lighting environments as well as to respond to input from a user of the display.

As displays get larger, they typically incorporate additional light sources. In some implementations, the light sources are distributed around the edges of the display to ensure that the display is uniformly illuminated across its entire surface. Unless the display incorporates more costly analog to digital converters into its display drivers to improve the precision with which it can control the output of each light source, the ability of the display to take full advantage of CABC techniques and to precisely reproduce its intended color gamut may be hampered. SUMMARY The systems, methods and devices of the disclosure each have several innovative aspects, no single one of which is solely responsible for the desirable attributes disclosed herein.

One innovative aspect of the subject matter described in this disclosure can be implemented in an apparatus having a backlight, a plurality of light sources associated with a first color, and illumination control logic coupled to the plurality of light sources. The illumination logic is configured to independently control a number of groups of the light sources to output a plurality of discrete output illumination intensity levels. The illumination logic is also configured to receive an input signal indicating a discrete whole backlight illumination intensity value for the first color to be output by the backlight. The illumination logic is further configured to, in response to the input signal indicating a whole backlight illumination intensity value that is not an integer multiple of the number of groups, controlling at least one of the groups to be illuminated at a lesser intensity level than a remainder of the groups such that an illumination output of the backlight is substantially uniform across its surface and the total illumination intensity level of the groups of light sources is substantially equal to the whole backlight illumination intensity value indicated in the received input signal.

In some implementations, the lesser intensity level is less than the intensity level of the remainder of groups of light sources by only a single discrete illumination intensity level. In some implementations, the illumination control logic is further configured to illuminate up to one-half the number of independently controlled groups of light sources at the lesser intensity level. In some implementations, the illumination logic is configured, to switch the at least one group of light sources outputting the lesser illumination level to a second set of the at least one group of light sources.

In some other implementations, the illumination logic is configured to cause the at least one group of light sources to be illuminated at the lesser illumination intensity for less than an entirety of a period of time, and at a greater intensity for the remainder of the period of time, while maintaining the total illumination intensity level of the groups of light sources to be substantially equal to the whole backlight illumination intensity value for the period of time. In some implementations, the at least one group of light sources includes all of the groups of light sources.

In some implementations, each group of light sources includes only one light source. In some implementations, the light sources comprise light emitting diodes (LEDs). In some implementations, the apparatus also includes a display having the backlight, the plurality of light sources, and illumination control logic, a processor that is configured to communicate with the display, the processor being configured to process image data, and a memory device that is configured to communicate with the processor.

In some implementations, the display further includes a driver circuit configured to send at least one signal to the display, and a controller configured to send at least a portion of the image data to the driver circuit. In some implementations, the display further includes an image source module configured to send the image data to the processor, where the image source module includes at least one of a receiver, transceiver, and transmitter, and an input device configured to receive input data and to communicate the input data to the processor.

Another innovative aspect of the subject matter described in this disclosure can be implemented in a method including receiving an input signal indicating a discrete whole backlight illumination intensity value for a first color to be output by a backlight having a plurality of light sources of the first color. In response to receiving the input signal indicating the whole backlight illumination intensity value is not an integer multiple of a number of independently controlled groups of the plurality of light sources, independently controlling at least one of the number of groups to be illuminated at a lesser illumination intensity level than that of a remainder of the groups such that an illumination output of the backlight is substantially uniform across its surface and a total illumination intensity level of the number of groups is substantially equal to the whole backlight illumination intensity value indicated in the received input signal.

In some implementations, the lesser intensity level is less than the intensity level of the remainder of groups of light sources by only a single discrete illumination intensity level. In some implementations, the at least one of the number of groups includes one half of the total number of groups.

In some implementations, the method further includes switching the at least one of the number of groups outputting the lesser illumination level to a second set of at least one of the number of groups while maintaining the total illumination intensity level of the groups of light sources to be equal to the whole backlight illumination intensity value. In some other implementations, the method further includes maintaining the total illumination intensity level of the groups of light sources to be equal to the whole backlight illumination intensity value for a period of time. In such implementations, the method also includes controlling the at least one of the number of groups to be illuminated at the lesser illumination intensity level for less than the entirety of the period of time and at a greater intensity for the remainder of the period of time.

In some implementations, the at least one of the number of groups includes all of the plurality of light sources. In some other implementations, each of the number of groups includes only one light source. In some other implementations, the plurality of light sources include light emitting diodes Details of one or more implementations of the subject matter described in this specification are set forth in the accompanying drawings and the description below. Although the examples provided in this summary are primarily described in terms of MEMS-based displays, the concepts provided herein may apply to other types of displays, such as liquid crystal displays (LCDs), organic light emitting diode (OLED) displays, electrophoretic displays, and field emission displays, as well as to other non-display MEMS devices, such as MEMS microphones, sensors, and optical switches. Other features, aspects, and advantages will become apparent from the description, the drawings, and the claims. Note that the relative dimensions of the following figures may not be drawn to scale.

Figure 1A:
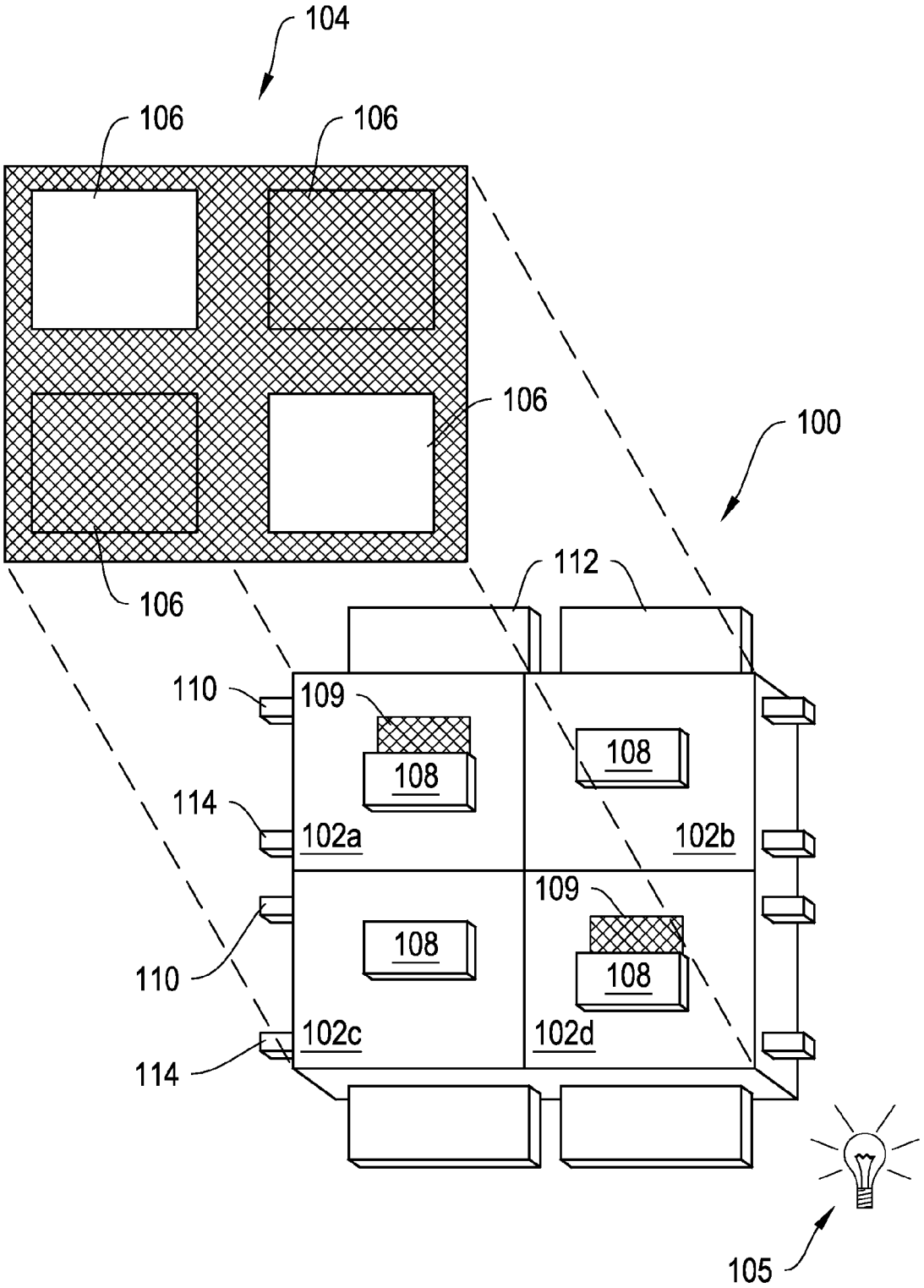
FIG. 1A shows an example schematic diagram of a direct-view microelectromechanical systems (MEMS) based display apparatus.

Like reference numbers and designations in the various drawings indicate like elements. DETAILED DESCRIPTION The following description is directed to certain implementations for the purposes of describing the innovative aspects of this disclosure. However, a person having ordinary skill in the art will readily recognize that the teachings herein can be applied in a multitude of different ways. The described implementations may be implemented in any device, apparatus, or system that can be configured to display an image, whether in motion (such as video) or stationary (such as still images), and whether textual, graphical or pictorial. More particularly, it is contemplated that the described implementations may be included in or associated with a variety of electronic devices such as, but not limited to: mobile telephones, multimedia Internet enabled cellular telephones, mobile television receivers, wireless devices, smartphones, Bluetooth® devices, personal data assistants (PDAs), wireless electronic mail receivers, hand-held or portable computers, netbooks, notebooks, smartbooks, tablets, printers, copiers, scanners, facsimile devices, global positioning system (GPS) receivers/navigators, cameras, digital media players (such as MP3 players), camcorders, game consoles, wrist watches, clocks, calculators, television monitors, flat panel displays, electronic reading devices (for example, e-readers), computer monitors, auto displays (including odometer and speedometer displays, etc.), cockpit controls and/or displays, camera view displays (such as the display of a rear view camera in a vehicle), electronic photographs, electronic billboards or signs, projectors, architectural structures, microwaves, refrigerators, stereo systems, cassette recorders or players, DVD players, CD players, VCRs, radios, portable memory chips, washers, dryers, washer/dryers, parking meters, packaging (such as in electromechanical systems (EMS) applications including microelectromechanical systems (MEMS) applications, as well as non-EMS applications), aesthetic structures (such as display of images on a piece of jewelry or clothing) and a variety of EMS devices. The teachings herein also can be used in non-display applications such as, but not limited to, electronic switching devices, radio frequency filters, sensors, accelerometers, gyroscopes, motion-sensing devices, magnetometers, inertial components for consumer electronics, parts of consumer electronics products, varactors, liquid crystal devices, electrophoretic devices, drive schemes, manufacturing processes and electronic test equipment. Thus, the teachings are not intended to be limited to the implementations depicted solely in the Figures, but instead have wide applicability as will be readily apparent to one having ordinary skill in the art.

The light output resolution of a multi-light source backlight can be improved by incorporating illumination logic that can independently control the illumination intensity levels of individual light sources or groups of light sources. By doing so, if the illumination logic receives a signal to output a whole backlight illumination intensity value that is not an integer multiple of the number of light sources in the backlight, the illumination logic can selectively illuminate one or more of the light sources at a lesser illumination intensity level such that the overall illumination output by the backlight matches the received illumination intensity level while still providing substantially uniform light output.

In some implementations, the uniformity of the backlight output is improved by the illumination logic modifying the output of one or more of the light sources over time. For example, the illumination logic can vary the illumination intensity levels from one portion of an illumination period to another portion of the illumination period. The illumination logic can control a different light source to be illuminated at the lesser illumination intensity level during different portions of the illumination period. In some other implementations, the illumination logic can control a different group of light sources to be illuminated at a lesser illumination intensity level during different portions of the illumination period. In some implementations, the illumination logic may cyclically vary the light source or the group of light sources to be illuminated at a lesser illumination intensity level during different portions of the illumination period.

In some other implementations, the illumination logic can control each of the light sources to be illuminated at a lesser illumination intensity level for one or more portions of an illumination period and at a higher illumination intensity level in the remainder of the illumination period, such that an average of the overall intensity level of the light sources over the illumination period is substantially equal to the desired whole backlight illumination intensity value.

Particular implementations of the subject matter described in this disclosure can be implemented to realize one or more of the following potential advantages. Individually controlling light sources in a backlight increases the number of discrete illumination intensity levels that can be achieved with a given number of light sources. This improvement in the number of intensity levels is achieved without increasing the resolutions of digital-to-analog converters (DACs) used to control the light sources, which can be costly. This improvement in the number of intensity levels allows the backlight to provide improved reproduction of a desired color gamut.

The illumination intensity levels of individual light sources can be controlled in such a manner that the overall illumination intensity of the backlight is substantially equal to a desired whole backlight illumination intensity value. Furthermore, the illumination levels can be controlled in a manner that the illumination across the surface of the backlight is substantially uniform. The uniform illumination of the backlight can provide improved viewing of the rendered image by a viewer.

In some implementations, the uniformity of the illumination across the surface of the backlight is improved by temporally switching the illumination intensity levels of various light sources over various portions of an illumination period. This switching further improves the uniformity of the backlight, which, in turn, improves the viewing of the rendered image by the viewer.

FIG. 1A shows a schematic diagram of an example direct-view MEMS-based display apparatus 100. The display apparatus 100 includes a plurality of light modulators 102*a*-102*d* (generally "light modulators 102") arranged in rows and columns. In the display apparatus 100, the light modulators 102*a* and 102*d* are in the open state, allowing light to pass. The light modulators 102*b* and 102*c* are in the closed state, obstructing the passage of light. By selectively setting the states of the light modulators 102*a*-102*d*, the display apparatus 100 can be utilized to form an image 104 for a backlit display, if illuminated by a lamp or lamps 105. In another implementation, the apparatus 100 may form an image by reflection of ambient light originating from the front of the apparatus. In another implementation, the apparatus 100 may form an image by reflection of light from a lamp or lamps positioned in the front of the display, i.e., by use of a front light.

In some implementations, each light modulator 102 corresponds to a pixel 106 in the image 104. In some other implementations, the display apparatus 100 may utilize a plurality of light modulators to form a pixel 106 in the image 104. For example, the display apparatus 100 may include three color-specific light modulators 102. By selectively opening one or more of the color-specific light modulators 102 corresponding to a particular pixel 106, the display apparatus 100 can generate a color pixel 106 in the image 104. In another example, the display apparatus 100 includes two or more light modulators 102 per pixel 106 to provide luminance level in an image 104. With respect to an image, a "pixel" corresponds to the smallest picture element defined by the resolution of image. With respect to structural components of the display apparatus 100, the term "pixel" refers to the combined mechanical and electrical components utilized to modulate the light that forms a single pixel of the image.

The display apparatus 100 is a direct-view display in that it may not include imaging optics typically found in projection applications. In a projection display, the image formed on the surface of the display apparatus is projected onto a screen or onto a wall. The display apparatus is substantially smaller than the projected image. In a direct view display, the user sees the image by looking directly at the display apparatus, which contains the light modulators and optionally a backlight or front light for enhancing brightness and/or contrast seen on the display.

Direct-view displays may operate in either a transmissive or reflective mode. In a transmissive display, the light modulators filter or selectively block light which originates from a lamp or lamps positioned behind the display. The light from the lamps is optionally injected into a lightguide or "backlight" so that each pixel can be uniformly illuminated. Transmissive direct-view displays are often built onto transparent or glass substrates to facilitate a sandwich assembly arrangement where one substrate, containing the light modulators, is positioned directly on top of the backlight.

Each light modulator 102 can include a shutter 108 and an aperture 109. To illuminate a pixel 106 in the image 104, the shutter 108 is positioned such that it allows light to pass through the aperture 109 towards a viewer. To keep a pixel 106 unlit, the shutter 108 is positioned such that it obstructs the passage of light through the aperture 109. The aperture 109 is defined by an opening patterned through a reflective or light-absorbing material in each light modulator 102.

The display apparatus also includes a control matrix connected to the substrate and to the light modulators for controlling the movement of the shutters. The control matrix includes a series of electrical interconnects (such as interconnects 110, 112 and 114), including at least one write-enable interconnect 110 (also referred to as a "scan-line interconnect") per row of pixels, one data interconnect 112 for each column of pixels, and one common interconnect 114 providing a common voltage to all pixels, or at least to pixels from both multiple columns and multiples rows in the display apparatus 100. In response to the application of an appropriate voltage (the "write-enabling voltage, $V_{WE}$"), the write-enable interconnect 110 for a given row of pixels prepares the pixels in the row to accept new shutter movement instructions. The data interconnects 112 communicate the new movement instructions in the form of data voltage pulses. The data voltage pulses applied to the data interconnects 112, in some implementations, directly contribute to an electrostatic movement of the shutters. In some other implementations, the data voltage pulses control switches, such as transistors or other non-linear circuit elements that control the application of separate actuation voltages, which are typically higher in magnitude than the data voltages, to the light modulators 102. The application of these actuation voltages then results in the electrostatic driven movement of the shutters 108.

Figure 1B:
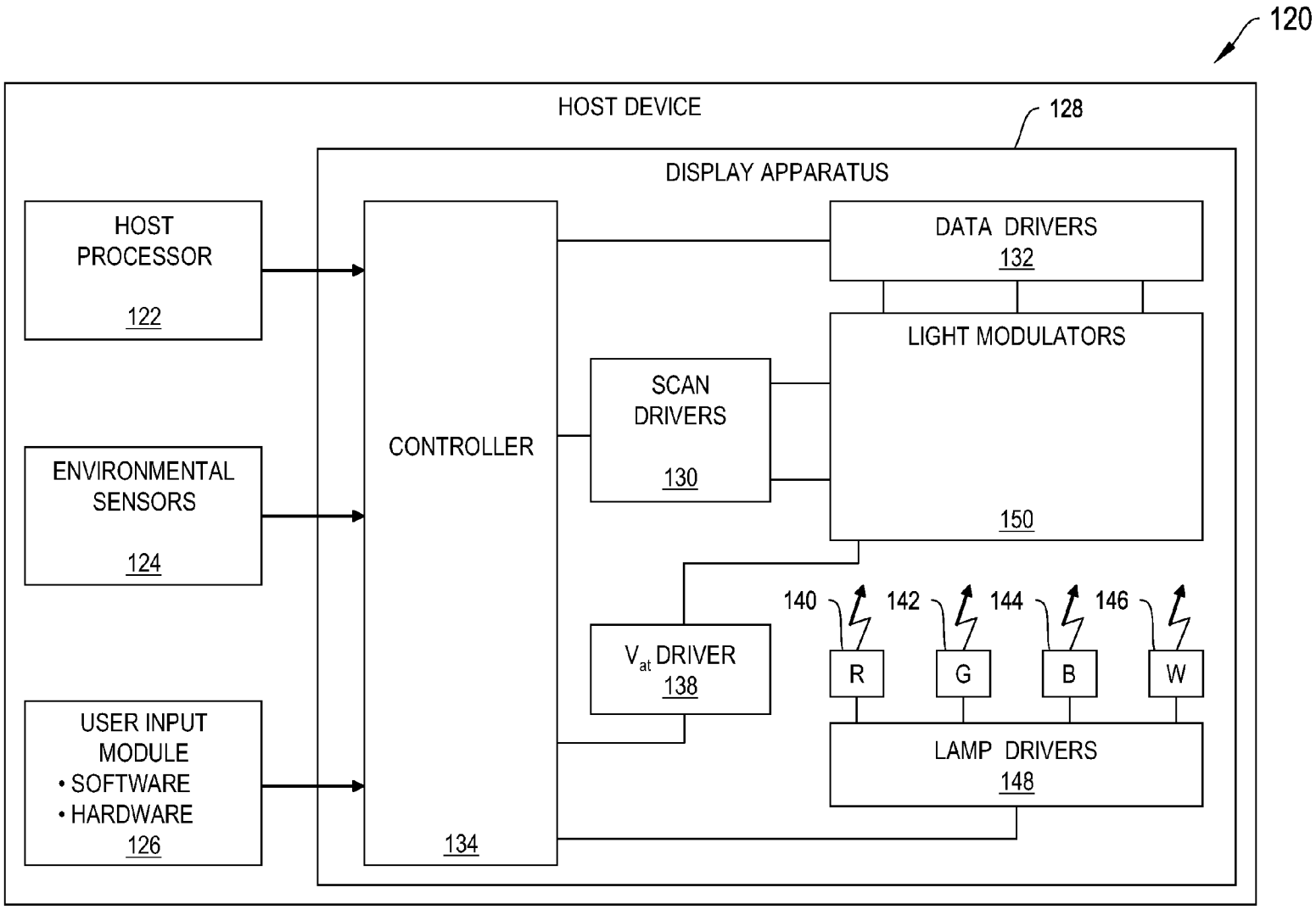
FIG. 1B shows an example block diagram of a host device.

FIG. 1B shows a block diagram of an example host device 120 (i.e., cell phone, smart phone, PDA, MP3 player, tablet, e-reader, netbook, notebook, etc.). The host device 120 includes a display apparatus 128, a host processor 122, environmental sensors 124, a user input module 126, and a power source.

The display apparatus 128 includes a plurality of scan drivers 130 (also referred to as "write enabling voltage sources"), a plurality of data drivers 132 (also referred to as "data voltage sources"), a controller 134, common drivers 138, lamps 140-146, lamp drivers 148 and an array 150 of display elements, such as the light modulators 102 shown in FIG. 1A. The scan drivers 130 apply write enabling voltages to scan-line interconnects 110. The data drivers 132 apply data voltages to the data interconnects 112.

In some implementations of the display apparatus, the data drivers 132 are configured to provide analog data voltages to the array 150 of display elements, especially where the luminance level of the image 104 is to be derived in analog fashion. In analog operation, the light modulators 102 are designed such that when a range of intermediate voltages is applied through the data interconnects 112, there results a range of intermediate open states in the shutters 108 and therefore a range of intermediate illumination states or luminance levels in the image 104. In other cases, the data drivers 132 are configured to apply only a reduced set of 2, 3 or 4 digital voltage levels to the data interconnects 112. These voltage levels are designed to set, in digital fashion, an open state, a closed state, or other discrete state to each of the shutters 108.

The scan drivers 130 and the data drivers 132 are connected to a digital controller circuit 134 (also referred to as the "controller 134"). The controller sends data to the data drivers 132 in a mostly serial fashion, organized in sequences, which in some implementations may be predetermined, grouped by rows and by image frames. The data drivers 132 can include series to parallel data converters, level shifting, and for some applications digital to analog voltage converters.

The display apparatus optionally includes a set of common drivers 138, also referred to as common voltage sources. In some implementations, the common drivers 138 provide a DC common potential to all display elements within the array 150 of display elements, for instance by supplying voltage to a series of common interconnects 114. In some other implementations, the common drivers 138, following commands from the controller 134, issue voltage pulses or signals to the array 150 of display elements, for instance global actuation pulses which are capable of driving and/or initiating simultaneous actuation of all display elements in multiple rows and columns of the array 150.

All of the drivers (such as scan drivers 130, data drivers 132 and common drivers 138) for different display functions are time-synchronized by the controller 134. Timing commands from the controller coordinate the illumination of red, green and blue and white lamps (140, 142, 144 and 146 respectively) via lamp drivers 148, the write-enabling and sequencing of specific rows within the array 150 of display elements, the output of voltages from the data drivers 132, and the output of voltages that provide for display element actuation. In some implementations, the lamps are light emitting diodes (LEDs).

The controller 134 determines the sequencing or addressing scheme by which each of the shutters 108 can be re-set to the illumination levels appropriate to a new image 104. New images 104 can be set at periodic intervals. For instance, for video displays, the color images 104 or frames of video are refreshed at frequencies ranging from 10 to 300 Hertz (Hz). In some implementations the setting of an image frame to the array 150 is synchronized with the illumination of the lamps 140, 142, 144 and 146 such that alternate image frames are illuminated with an alternating series of colors, such as red, green, and blue. The image frames for each respective color is referred to as a color subframe. In this method, referred to as the field sequential color method, if the color subframes are alternated at frequencies in excess of 20 Hz, the human brain will average the alternating frame images into the perception of an image having a broad and continuous range of colors. In alternate implementations, four or more lamps with primary colors can be employed in display apparatus 100, employing primaries other than red, green, and blue.

In some implementations, where the display apparatus 100 is designed for the digital switching of shutters 108 between open and closed states, the controller 134 forms an image by the method of time division gray scale, as previously described. In some other implementations, the display apparatus 100 can provide gray scale through the use of multiple shutters 108 per pixel.

In some implementations, the data for an image state 104 is loaded by the controller 134 to the display element array 150 by a sequential addressing of individual rows, also referred to as scan lines. For each row or scan line in the sequence, the scan driver 130 applies a write-enable voltage to the write enable interconnect 110 for that row of the array 150, and subsequently the data driver 132 supplies data voltages, corresponding to desired shutter states, for each column in the selected row. This process repeats until data has been loaded for all rows in the array 150. In some implementations, the sequence of selected rows for data loading is linear, proceeding from top to bottom in the array 150. In some other implementations, the sequence of selected rows is pseudo-randomized, in order to minimize visual artifacts. And in some other implementations the sequencing is organized by blocks, where, for a block, the data for only a certain fraction of the image state 104 is loaded to the array 150, for instance by addressing only every $5^{th}$ row of the array 150 in sequence.

In some implementations, the process for loading image data to the array 150 is separated in time from the process of actuating the display elements in the array 150. In these implementations, the display element array 150 may include data memory elements for each display element in the array 150 and the control matrix may include a global actuation interconnect for carrying trigger signals, from common driver 138, to initiate simultaneous actuation of shutters 108 according to data stored in the memory elements.

In alternative implementations, the array 150 of display elements and the control matrix that controls the display elements may be arranged in configurations other than rectangular rows and columns. For example, the display elements can be arranged in hexagonal arrays or curvilinear rows and columns. In general, as used herein, the term scan-line shall refer to any plurality of display elements that share a write-enabling interconnect.

The host processor 122 generally controls the operations of the host. For example, the host processor 122 may be a general or special purpose processor for controlling a portable electronic device. With respect to the display apparatus 128, included within the host device 120, the host processor 122 outputs image data as well as additional data about the host. Such information may include data from environmental sensors, such as ambient light or temperature; information about the host, including, for example, an operating mode of the host or the amount of power remaining in the host's power source; information about the content of the image data; information about the type of image data; and/or instructions for display apparatus for use in selecting an imaging mode.

The user input module 126 conveys the personal preferences of the user to the controller 134, either directly, or via the host processor 122. In some implementations, the user input module 126 is controlled by software in which the user programs personal preferences such as "deeper color," "better contrast," "lower power," "increased brightness," "sports," "live action," or "animation." In some other implementations, these preferences are input to the host using hardware, such as a switch or dial. The plurality of data inputs to the controller 134 direct the controller to provide data to the various drivers 130, 132, 138 and 148 which correspond to optimal imaging characteristics.

An environmental sensor module 124 also can be included as part of the host device 120. The environmental sensor module 124 receives data about the ambient environment, such as temperature and or ambient lighting conditions. The sensor module 124 can be programmed to distinguish whether the device is operating in an indoor or office environment versus an outdoor environment in bright daylight versus an outdoor environment at nighttime. The sensor module 124 communicates this information to the display controller 134, so that the controller 134 can optimize the viewing conditions in response to the ambient environment.

Figure 2A:
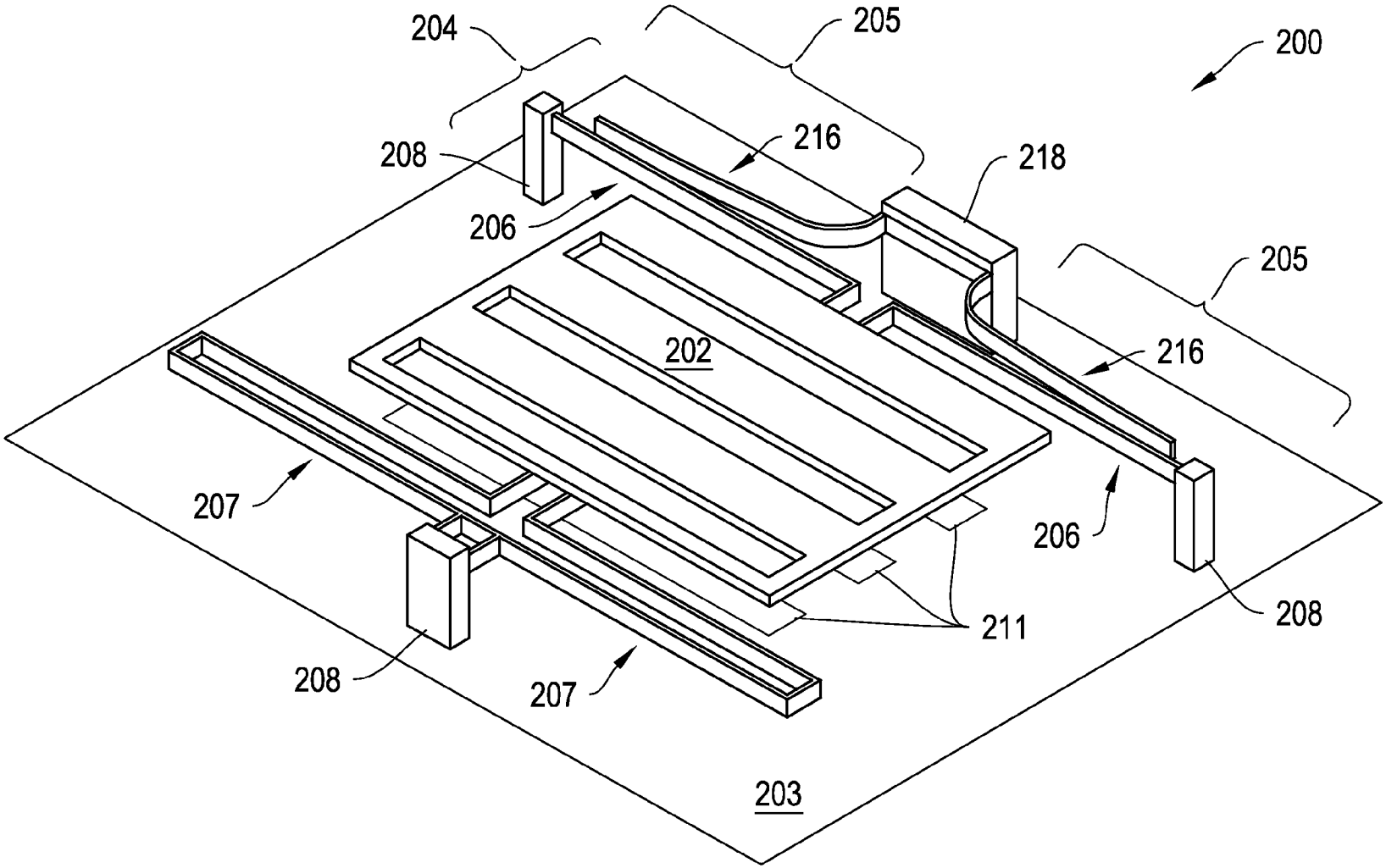
FIG. 2A shows an example perspective view of an illustrative shutter-based light modulator.

FIG. 2A shows a perspective view of an example shutter-based light modulator 200. The shutter-based light modulator 200 is suitable for incorporation into the direct-view MEMS-based display apparatus 100 of FIG. 1A. The light modulator 200 includes a shutter 202 coupled to an actuator 204. The actuator 204 can be formed from two separate compliant electrode beam actuators 205 (the "actuators 205"). The shutter 202 couples on one side to the actuators 205. The actuators 205 move the shutter 202 transversely over a substrate 203 in a plane of motion which is substantially parallel to the substrate 203. The opposite side of the shutter 202 couples to a spring 207 which provides a restoring force opposing the forces exerted by the actuator 204.

Each actuator 205 includes a compliant load beam 206 connecting the shutter 202 to a load anchor 208. The load anchors 208 along with the compliant load beams 206 serve as mechanical supports, keeping the shutter 202 suspended proximate to the substrate 203. The substrate 203 includes one or more aperture holes 211 for admitting the passage of light. The load anchors 208 physically connect the compliant load beams 206 and the shutter 202 to the substrate 203 and electrically connect the load beams 206 to a bias voltage, in some instances, ground.

If the substrate is opaque, such as silicon, then aperture holes 211 are formed in the substrate by etching an array of holes through the substrate 203. If the substrate 203 is transparent, such as glass or plastic, then the aperture holes 211 are formed in a layer of light-blocking material deposited on the substrate 203. The aperture holes 211 can be generally circular, elliptical, polygonal, serpentine, or irregular in shape.

Each actuator 205 also includes a compliant drive beam 216 positioned adjacent to each load beam 206. The drive beams 216 couple at one end to a drive beam anchor 218 shared between the drive beams 216. The other end of each drive beam 216 is free to move. Each drive beam 216 is curved such that it is closest to the load beam 206 near the free end of the drive beam 216 and the anchored end of the load beam 206.

In operation, a display apparatus incorporating the light modulator 200 applies an electric potential to the drive beams 216 via the drive beam anchor 218. A second electric potential may be applied to the load beams 206. The resulting potential difference between the drive beams 216 and the load beams 206 pulls the free ends of the drive beams 216 towards the anchored ends of the load beams 206, and pulls the shutter ends of the load beams 206 toward the anchored ends of the drive beams 216, thereby driving the shutter 202 transversely toward the drive beam anchor 218. The compliant load beams 206 act as springs, such that when the voltage across the beams 206 and 216 potential is removed, the load beams 206 push the shutter 202 back into its initial position, releasing the stress stored in the load beams 206.

A light modulator, such as the light modulator 200, incorporates a passive restoring force, such as a spring, for returning a shutter to its rest position after voltages have been removed. Other shutter assemblies can incorporate a dual set of "open" and "closed" actuators and a separate set of "open" and "closed" electrodes for moving the shutter into either an open or a closed state.

There are a variety of methods by which an array of shutters and apertures can be controlled via a control matrix to produce images, in many cases moving images, with appropriate luminance levels. In some cases, control is accomplished by means of a passive matrix array of row and column interconnects connected to driver circuits on the periphery of the display. In other cases it is appropriate to include switching and/or data storage elements within each pixel of the array (the so-called active matrix) to improve the speed, the luminance level and/or the power dissipation performance of the display.

Figure 2B:
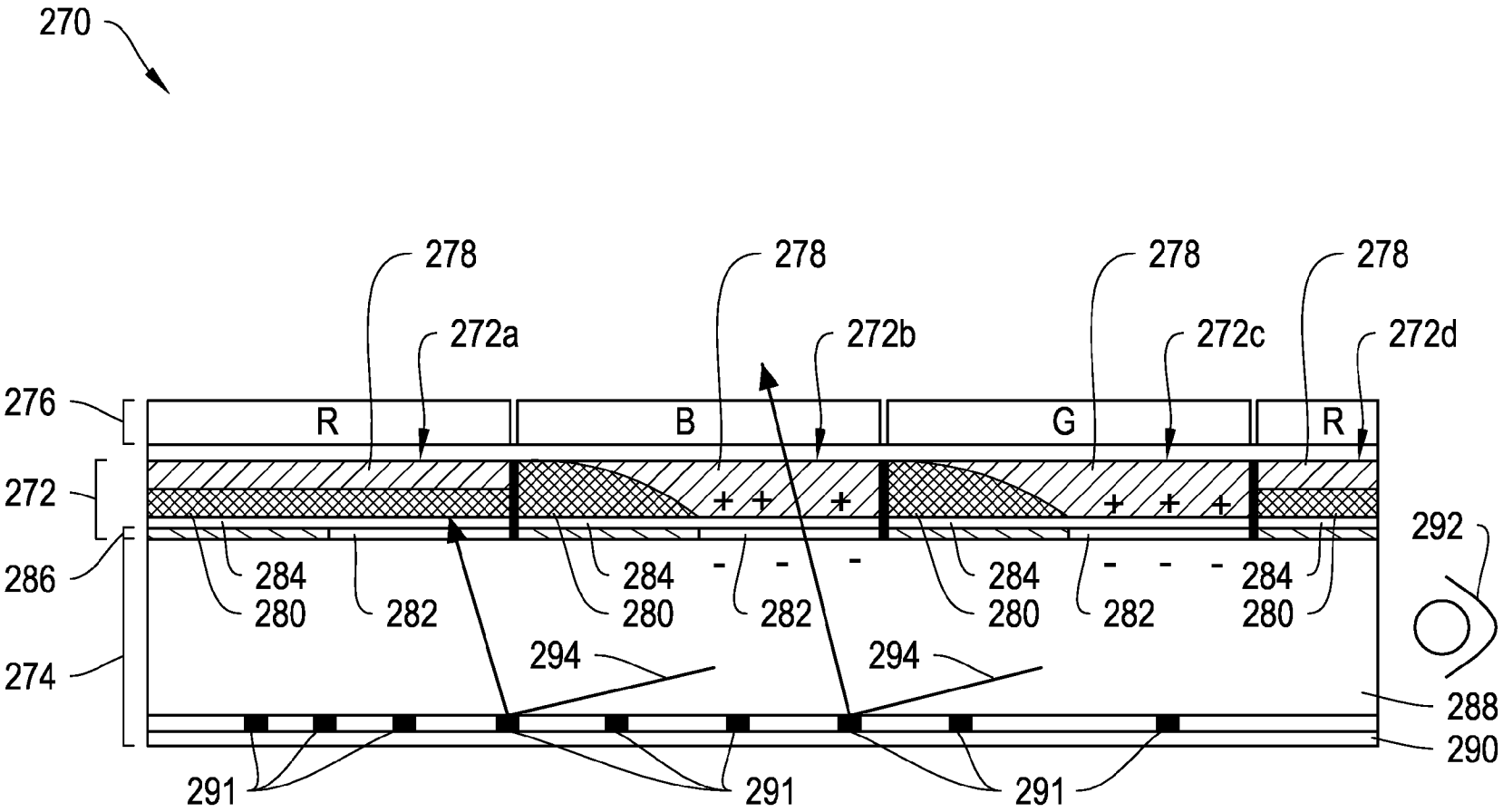
FIG. 2B shows an example cross sectional view of an illustrative non shutter-based MEMS light modulator.

FIG. 2B shows an example cross sectional view of an illustrative non shutter-based MEMS light modulator 250. The light tap modulator 250 is suitable for incorporation into an alternative implementation of the MEMS-based display apparatus 100 of FIG. 1A. A light tap works according to a principle of frustrated total internal reflection (TIR). That is, light 252 is introduced into a light guide 254, in which, without interference, light 252 is, for the most part, unable to escape the light guide 254 through its front or rear surfaces due to TIR. The light tap 250 includes a tap element 256 that has a sufficiently high index of refraction that, in response to the tap element 256 contacting the light guide 254, the light 252 impinging on the surface of the light guide 254 adjacent the tap element 256 escapes the light guide 254 through the tap element 256 towards a viewer, thereby contributing to the formation of an image.

In some implementations, the tap element 256 is formed as part of a beam 258 of flexible, transparent material. Electrodes 260 coat portions of one side of the beam 258. Opposing electrodes 262 are disposed on the light guide 254. By applying a voltage across the electrodes 260 and 262, the position of the tap element 256 relative to the light guide 254 can be controlled to selectively extract light 252 from the light guide 254.

Figure 3:
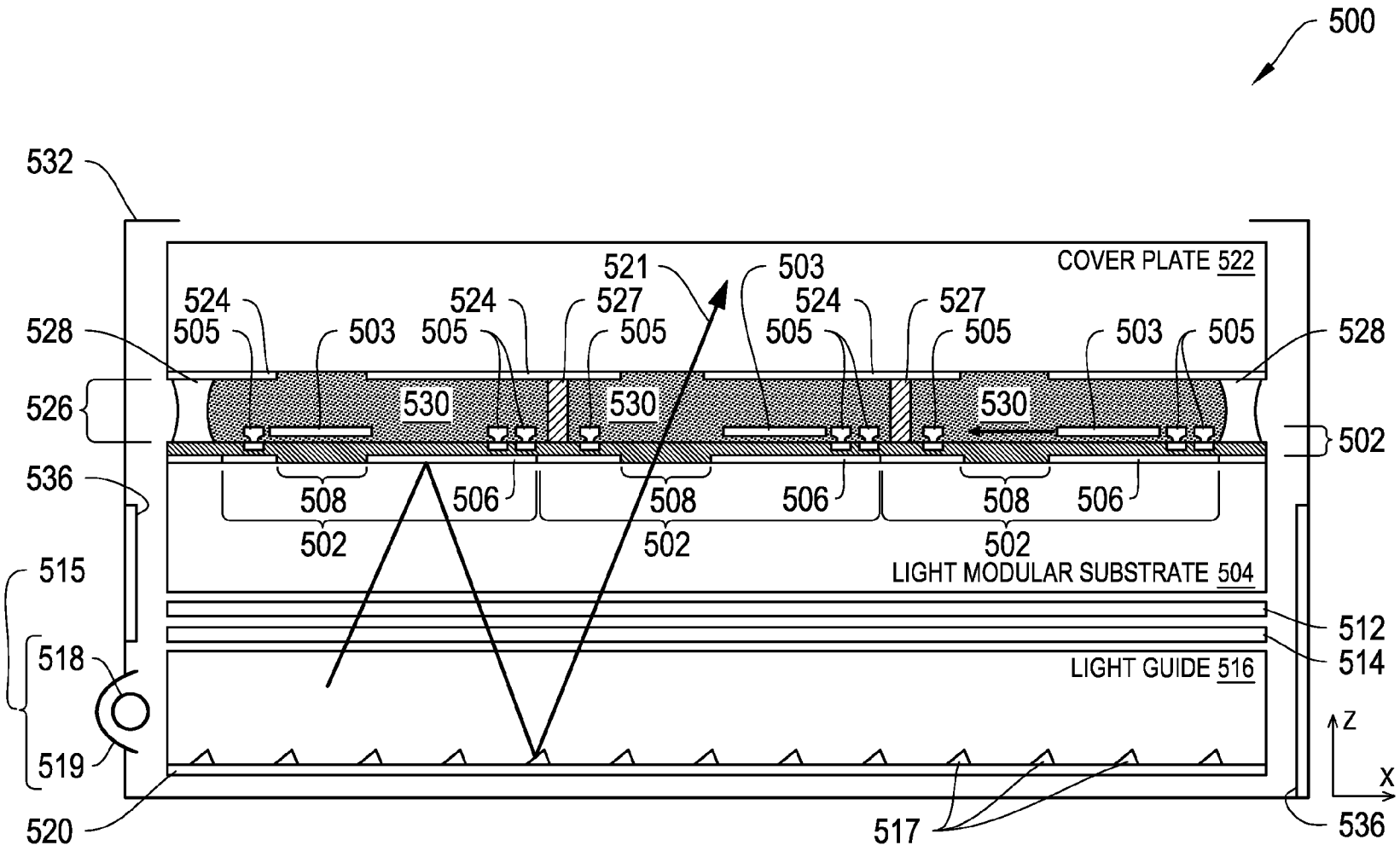
FIG. 3 shows an example cross sectional view of a display apparatus incorporating shutter-based light modulators.

FIG. 3 shows a cross sectional view of an example display apparatus 500 incorporating shutter-based light modulators (shutter assemblies) 502. Each shutter assembly 502 incorporates a shutter 503 and an anchor 505. Not shown are the compliant beam actuators which, when connected between the anchors 505 and the shutters 503, help to suspend the shutters 503 a short distance above the surface. The shutter assemblies 502 are disposed on a transparent substrate 504, such a substrate made of plastic or glass. A rear-facing reflective layer or reflective film 506, disposed on the substrate 504 defines a plurality of surface apertures 508 located beneath the closed positions of the shutters 503 of the shutter assemblies 502. The reflective film 506 reflects light not passing through the surface apertures 508 back towards the rear of the display apparatus 500. The reflective film 506 can be a fine-grained metal film without inclusions formed in thin film fashion by a number of vapor deposition techniques including sputtering, evaporation, ion plating, laser ablation, or chemical vapor deposition (CVD). In some other implementations, the reflective film 506 can be formed from a mirror, such as a dielectric mirror. A dielectric mirror can be fabricated as a stack of dielectric thin films which alternate between materials of high and low refractive index. The vertical gap which separates the shutters 503 from the reflective film 506, within which the shutter is free to move, is in the range of 0.5 to 10 microns. The magnitude of the vertical gap is preferably less than the lateral overlap between the edge of shutters 503 and the edge of apertures 508 in the closed state.

The display apparatus 500 includes an optional diffuser 512 and/or an optional brightness enhancing film 514 which separate the substrate 504 from a planar light guide 516. The light guide 516 includes a transparent, i.e., glass or plastic material. The light guide 516 is illuminated by one or more light sources 518, forming a backlight. The light sources 518 can be, for example, and without limitation, incandescent lamps, fluorescent lamps, lasers or light emitting diodes (LEDs). A reflector 519 helps direct light from lamp 518 towards the light guide 516. A front-facing reflective film 520 is disposed behind the backlight 516, reflecting light towards the shutter assemblies 502. Light rays such as ray 521 from the backlight that do not pass through one of the shutter assemblies 502 will be returned to the backlight and reflected again from the film 520. In this fashion light that fails to leave the display apparatus 500 to form an image on the first pass can be recycled and made available for transmission through other open apertures in the array of shutter assemblies 502. Such light recycling has been shown to increase the illumination efficiency of the display.

The light guide 516 includes a set of geometric light redirectors or prisms 517 which re-direct light from the lamps 518 towards the apertures 508 and hence toward the front of the display. The light redirectors 517 can be molded into the plastic body of light guide 516 with shapes that can be alternately triangular, trapezoidal, or curved in cross section. The density of the prisms 517 generally increases with distance from the lamp 518.

In some implementations, the reflective film 506 can be made of a light absorbing material, and in alternate implementations the surfaces of shutter 503 can be coated with either a light absorbing or a light reflecting material. In some other implementations, the reflective film 506 can be deposited directly on the surface of the light guide 516. In some implementations, the reflective film 506 need not be disposed on the same substrate as the shutters 503 and anchors 505 (such as in the MEMS-down configuration described below).

In some implementations, the light sources 518 can include lamps of different colors, for instance, the colors red, green and blue. A color image can be formed by sequentially illuminating images with lamps of different colors at a rate sufficient for the human brain to average the different colored images into a single multi-color image. The various color-specific images are formed using the array of shutter assemblies 502. In another implementation, the light source 518 includes lamps having more than three different colors. For example, the light source 518 may have red, green, blue and white lamps, or red, green, blue and yellow lamps. In some other implementations, the light source 518 may include cyan, magenta, yellow and white lamps, red, green, blue and white lamps. In some other implementations, additional lamps may be included in the light source 518. For example, if using five colors, the light source 518 may include red, green, blue, cyan and yellow lamps. In some other implementations, the light source 518 may include white, orange, blue, purple and green lamps or white, blue, yellow, red and cyan lamps. If using six colors, the light source 518 may include red, green, blue, cyan, magenta and yellow lamps or white, cyan, magenta, yellow, orange and green lamps.

A cover plate 522 forms the front of the display apparatus 500. The rear side of the cover plate 522 can be covered with a black matrix 524 to increase contrast. In alternate implementations the cover plate includes color filters, for instance distinct red, green, and blue filters corresponding to different ones of the shutter assemblies 502. The cover plate 522 is supported a distance away, which in some implementations may be predetermined, from the shutter assemblies 502 forming a gap 526. The gap 526 is maintained by mechanical supports or spacers 527 and/or by an adhesive seal 528 attaching the cover plate 522 to the substrate 504.

The adhesive seal 528 seals in a fluid 530. The fluid 530 is engineered with viscosities preferably below about 10 centipoise and with relative dielectric constant preferably above about 2.0, and dielectric breakdown strengths above about $10^4$ V/cm. The fluid 530 also can serve as a lubricant. In some implementations, the fluid 530 is a hydrophobic liquid with a high surface wetting capability. In alternate implementations, the fluid 530 has a refractive index that is either greater than or less than that of the substrate 504.

Displays that incorporate mechanical light modulators can include hundreds, thousands, or in some cases, millions of moving elements. In some devices, every movement of an element provides an opportunity for static friction to disable one or more of the elements. This movement is facilitated by immersing all the parts in a fluid (also referred to as fluid 530) and sealing the fluid (such as with an adhesive) within a fluid space or gap in a MEMS display cell. The fluid 530 is usually one with a low coefficient of friction, low viscosity, and minimal degradation effects over the long term. When the MEMS-based display assembly includes a liquid for the fluid 530, the liquid at least partially surrounds some of the moving parts of the MEMS-based light modulator. In some implementations, in order to reduce the actuation voltages, the liquid has a viscosity below 70 centipoise. In some other implementations, the liquid has a viscosity below 10 centipoise. Liquids with viscosities below 70 centipoise can include materials with low molecular weights: below 4000 grams/mole, or in some cases below 400 grams/mole. Fluids 530 that also may be suitable for such implementations include, without limitation, de-ionized water, methanol, ethanol and other alcohols, paraffins, olefins, ethers, silicone oils, fluorinated silicone oils, or other natural or synthetic solvents or lubricants. Useful fluids can be polydimethylsiloxanes (PDMS), such as hexamethyldisiloxane and octamethyltrisiloxane, or alkyl methyl siloxanes such as hexylpentamethyldisiloxane. Useful fluids can be alkanes, such as octane or decane. Useful fluids can be nitroalkanes, such as nitromethane. Useful fluids can be aromatic compounds, such as toluene or diethylbenzene. Useful fluids can be ketones, such as butanone or methyl isobutyl ketone. Useful fluids can be chlorocarbons, such as chlorobenzene. Useful fluids can be chlorofluorocarbons, such as dichlorofluoroethane or chlorotrifluoroethylene. Other fluids considered for these display assemblies include butyl acetate and dimethylformamide. Still other useful fluids for these displays include hydro fluoro ethers, perfluoropolyethers, hydro fluoro poly ethers, pentanol, and butanol. Example suitable hydro fluoro ethers include ethyl nonafluorobutyl ether and 2-trifluoromethyl-3-ethoxydodecafluorohexane.

A sheet metal or molded plastic assembly bracket 532 holds the cover plate 522, the substrate 504, the backlight and the other component parts together around the edges. The assembly bracket 532 is fastened with screws or indent tabs to add rigidity to the combined display apparatus 500. In some implementations, the light source 518 is molded in place by an epoxy potting compound. Reflectors 536 help return light escaping from the edges of the light guide 516 back into the light guide 516. Not depicted in FIG. 3 are electrical interconnects which provide control signals as well as power to the shutter assemblies 502 and the lamps 518.

In some other implementations, the light tap 250 as depicted in FIG. 2B, as well as other MEMS-based light modulators, can be substituted for the shutter assemblies 502 within the display apparatus 500.

The display apparatus 500 is referred to as the MEMS-up configuration, where the MEMS based light modulators are formed on a front surface of the substrate 504, i.e., the surface that faces toward the viewer. The shutter assemblies 502 are built directly on top of the reflective film 506. In an alternate implementation, referred to as the MEMS-down configuration, the shutter assemblies are disposed on a substrate separate from the substrate on which the reflective aperture layer is formed. The substrate on which the reflective aperture layer is formed, defining a plurality of apertures, is referred to herein as the aperture plate. In the MEMS-down configuration, the substrate that carries the MEMS-based light modulators takes the place of the cover plate 522 in the display apparatus 500 and is oriented such that the MEMS-based light modulators are positioned on the rear surface of the top substrate, i.e., the surface that faces away from the viewer and toward the light guide 516. The MEMS-based light modulators are thereby positioned directly opposite to and across a gap from the reflective film 506. The gap can be maintained by a series of spacer posts connecting the aperture plate and the substrate on which the MEMS modulators are formed. In some implementations, the spacers are disposed within or between each pixel in the array. The gap or distance that separates the MEMS light modulators from their corresponding apertures is preferably less than 10 microns, or a distance that is less than the overlap between shutters and apertures, such as overlap 416.

Figure 4:
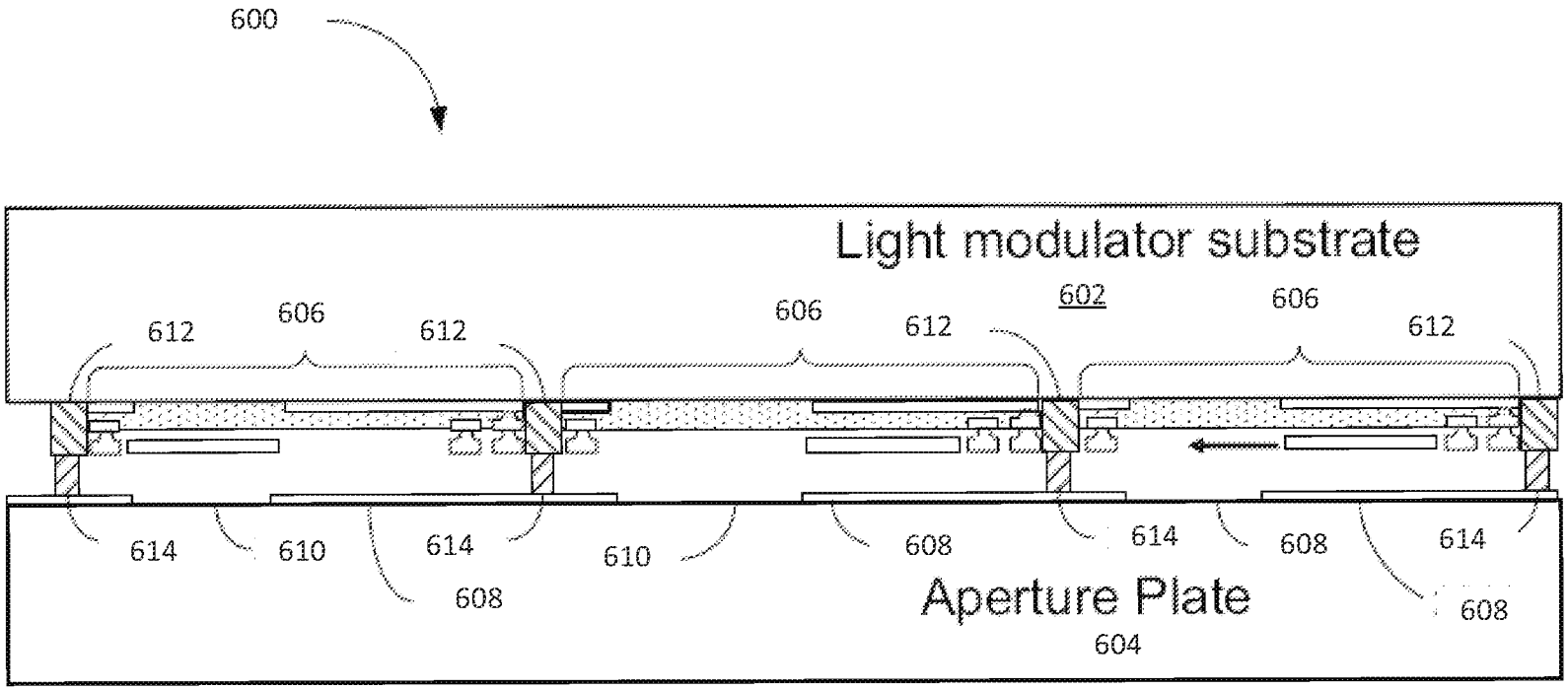
FIG. 4 shows a cross sectional view of an example light modulator substrate and an example aperture plate for use in a MEMS-down configuration of a display.

FIG. 4 shows a cross sectional view of an example light modulator substrate and an example aperture plate for use in a MEMS-down configuration of a display. The display assembly 600 includes a modulator substrate 602 and an aperture plate 604. The display assembly 600 also includes a set of shutter assemblies 606 and a reflective aperture layer 608. The reflective aperture layer 608 includes apertures 610. A gap or separation, which in some implementations may be predetermined, between the modulator substrates 602 and the aperture plate 604 is maintained by the opposing set of spacers 612 and 614. The spacers 612 are formed on or as part of the modulator substrate 602. The spacers 614 are formed on or as part of the aperture plate 604. During assembly, the two substrates 602 and 604 are aligned so that spacers 612 on the modulator substrate 602 make contact with their respective spacers 614.

The separation or distance of this illustrative example is 8 microns. To establish this separation, the spacers 612 are 2 microns tall and the spacers 614 are 6 microns tall. Alternately, both spacers 612 and 614 can be 4 microns tall, or the spacers 612 can be 6 microns tall while the spacers 614 are 2 microns tall. In fact, any combination of spacer heights can be employed as long as their total height establishes the desired separation H12.

Providing spacers on both of the substrates 602 and 604, which are then aligned or mated during assembly, has advantages with respect to materials and processing costs. The provision of a very tall, such as larger than 8 micron spacers, can be costly as it can require relatively long times for the cure, exposure, and development of a photo-imageable polymer. The use of mating spacers as in display assembly 600 allows for the use of thinner coatings of the polymer on each of the substrates.

In another implementation, the spacers 612 which are formed on the modulator substrate 602 can be formed from the same materials and patterning blocks that were used to form the shutter assemblies 606. For instance, the anchors employed for shutter assemblies 606 also can perform a function similar to spacer 612. In this implementation, a separate application of a polymer material to form a spacer would not be required and a separate exposure mask for the spacers would not be required.

In some implementations, the display assembly 600 also can include a backlight for providing illumination. The backlight can include light sources, a reflector, and a light guide similar to the light sources, the reflector 519 and the light guide 516 discussed above in relation to FIG. 3. The backlight can be situated behind the aperture plate 604. In some implementations, the display assembly also may include a front facing reflective film similar to the front facing reflective film 520 discussed above in relation to FIG. 3.

Figure 5:
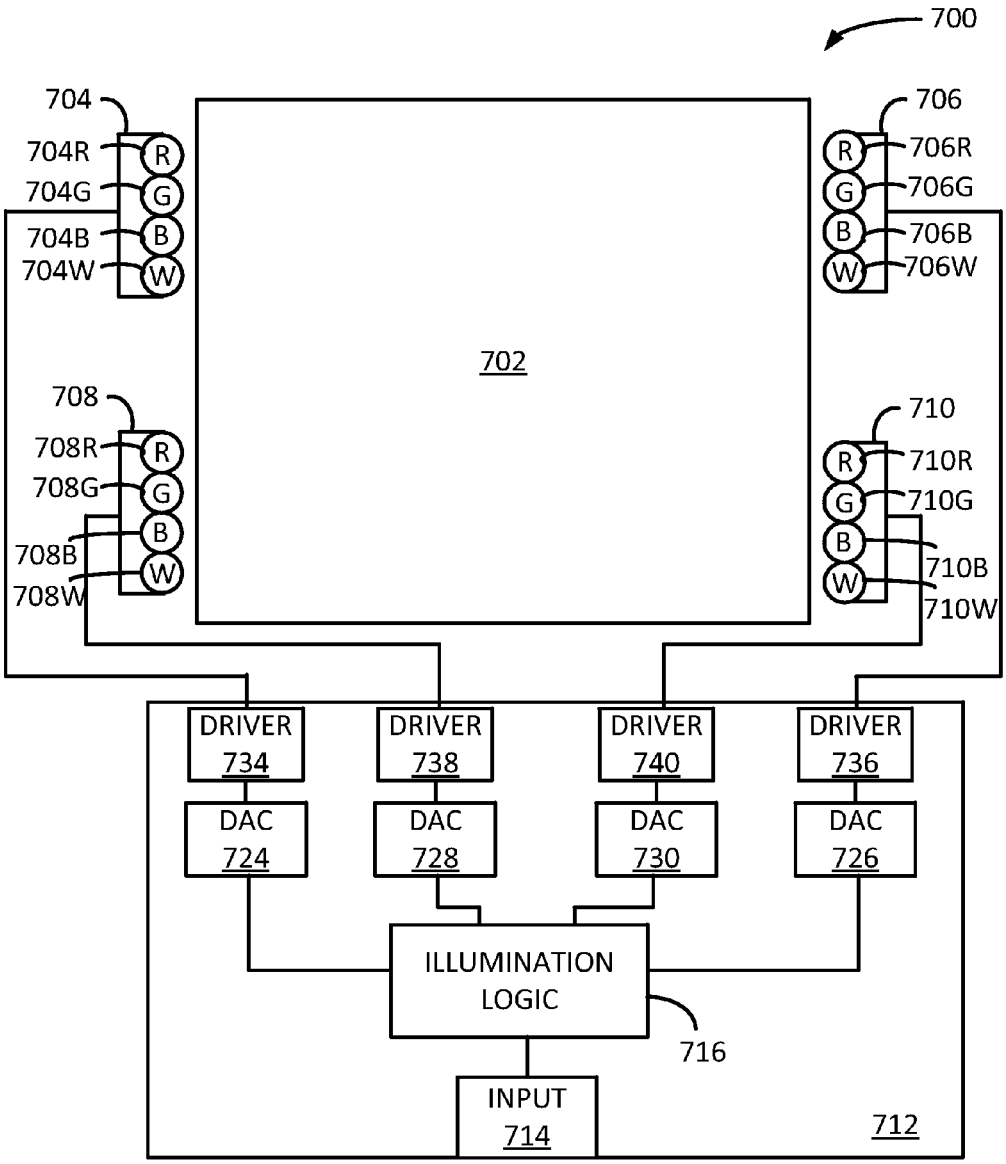
FIG. 5 shows an example block diagram of a backlight used in a display apparatus.

FIG. 5 shows an example block diagram of a backlight 700 used in a display apparatus. The backlight 700 includes a light guide 702, four sets of light emitting diodes (LEDs) 704, 706, 708 and 710 and a backlight controller 712. The four sets of LEDs 704, 706, 708 and 710 can be similar to the light sources 518 and the light guide 702 can be similar to the light guide 516 shown in FIG. 3. It should be noted that the light guide 702 can be any type of a lighting guide utilized in any variety of display applications. Thus, light emitted by one or more of the four sets of LEDs 704, 706, 708 and 710 is guided into the light guide 702, which provides substantially uniform illumination of an array of light modulators. A person of ordinary skill will readily understand that the number of sets of LEDs in a display is not limited to 4, as shown in FIG. 5, but can be any number suitable for providing a specified light intensity for the backlight 700. The use of four sets of LEDs is merely for illustrative purposes.

In some implementations, each of the four sets of LEDs 704, 706, 708 and 710 can include a red (R), a green (G), a blue (B), and a white (W) LED. For example, the first set of LEDs 704 includes a first red LED 704R, a first green LED 704G, a first blue LED 704B and a first white LED 704W; the second set of LEDs 706 includes a second red LED 706R, a second green LED 706G, a second blue LED 706B and a second white LED 706W; the third set of LEDs 708 includes a third red LED 708R, a third green LED 708G, a third blue LED 708B and a third white LED 708W; and the fourth set of LEDs 710 includes a fourth red LED 710R, a fourth green LED 710G, a fourth blue LED 710B and a fourth white LED 710W. Alternatively, other colors for producing the required color gamut also can be used, for example and without limitation, cyan, yellow, and magenta, 4-color combinations of red, blue, true green (about 520 nm) and parrot green (about 550 nm); 5-color combinations of red, green, blue, cyan and yellow or white blue, yellow, red and cyan; and 6-color combinations of red, green, blue, cyan, magenta and yellow.

In some implementations, each set of LEDs 704, 706, 708 and 710 can include multiple LEDs of one or more colors. For example, each set of LEDs 704, 706, 708 and 710 can include two each of the red, green, blue and white LEDs. The number of LEDs of each color, as well as the types of LEDs, can be selected based on, for example, the specified maximum intensity of light for each color, or other design considerations.

In some implementations, the LEDs in one or more of the four sets of LEDs 704, 706, 708 and 710 can be distributed among several housings and devices and placed at various locations around the light guide 702. For example, as shown in FIG. 5, the four sets of LEDs 704, 706, 708 and 710 can be placed near the four corners of the light guide 702. In some other implementations, one or more of the four sets of LEDs 704, 706, 708 and 710 can be combined into a single housing or device.

The backlight controller 712 is coupled to each of the four sets of LEDs 704, 706, 708 and 710. The backlight controller 712 includes an input 714, illumination logic 716, and a digital-to-analog converter (DAC) and a driver circuit for each of the four sets of LEDs 704, 706, 708 and 710. For example, the backlight controller 712 includes a first DAC 724 and a first driver 734 for the first set of LEDs 704, a second DAC 726 and a second driver 736 for the second set of LEDs 706, a third DAC 728 and a third driver 738 for the third set of LEDs 708, and a fourth DAC 730 and a fourth driver 740 for the fourth set of LEDs 710. In some implementations, the backlight controller 712 can share one or more single DACs and one or more single drivers among multiple sets of the four sets of LEDs 704, 706, 708 and 710.

The backlight controller 712 can be configured to receive a whole backlight illumination intensity value at its input 714. The input 714 can be an interconnect, a bus interface, a communication interface for serial and/or parallel communication, etc. The whole backlight illumination intensity value represents the desired intensity of light from the backlight 700. The backlight controller 712 can receive a whole backlight illumination intensity value corresponding to each color of illumination provided by the backlight 700. For example, the backlight controller 712 can receive four whole backlight illumination intensity values corresponding to the four colors (red, blue, green and white) of LEDs. The whole backlight illumination intensity value can be received from a controller (such as the controller 134 shown in FIG. 1B) controlling the display apparatus which utilizes the backlight 700. In some implementations, the whole backlight illumination intensity value is a digital value, but in other implementations, the whole backlight illumination intensity value can be an analog value.

The illumination logic 716 processes the received whole backlight illumination intensity value and determines appropriate discrete illumination intensity levels for each of the sets of LEDs. The illumination logic 716 can be a digital processor, microcontroller, application specific integrated circuit (ASIC), field programmable gate array (FPGA), or any other digital logic circuit. In some implementations, the illumination logic 716 may be implemented by the controller 134 discussed above in relation to FIG. 1B. In some other implementations, the illumination logic 716 may reside in the lamp drivers 148, also discussed in relation to 1B. In some other implementations, the illumination logic 716 may be implemented by a processor 21, discussed below in relation to FIG. 12B. In general, the illumination logic 716 can be implemented in any other logic device or processor incorporated into the display or as a separate standalone logic module. The illumination logic 716 can convert the received whole backlight illumination intensity value into appropriate illumination intensity levels based on, for example, a look-up table, a formula, or some other conversion function. As such, in some implementations, the illumination logic also may include memory (volatile, non-volatile, or both) to store data needed for such conversions.

After conversion, the illumination logic 716 outputs digital illumination intensity levels for each color in each of the four sets of LEDs 704, 706, 708 and 710 to the corresponding DAC. For example, the illumination logic 716 outputs a digital illumination intensity for each of the four LEDs 704R, 704G, 704B and 704W in the first set of LEDs 704 to the first DAC 724. The DACs 724, 726, 728 and 730 can be binary-weighted DACs, R-2R ladder DACs, successive-approximation DACs, or any other DAC that can convert the digital illumination intensity levels received from the illumination logic 716 into analog control signals (voltage or current) for controlling the current output of a corresponding driver. The first DAC 724 generates analog control signals for one or more of the four LEDs 704R, 704G, 704B and 704W and feeds the generated control signal to the driver 734. The driver 734 drives the one or more of the four LEDs 704R, 704G, 704B and 704W with a current corresponding to the received analog control signal, thereby illuminating the respective LEDs to the appropriate illumination intensity level. The remaining drivers 736, 738, and 740 operate in a similar manner to drive LEDs in their corresponding sets of LEDs 706, 708 and 710, respectively. In some implementations, each driver 734, 736, 738, and 740 can include a separate driver for each of the LEDs in the corresponding set of LEDs. For example, the driver 734 can include four separate drivers, each driving one of the four LEDs 704R, 704G, 704B, and 704W of the first set of LEDs 704.

In some cases, the whole backlight illumination intensity value for a color received by the illumination logic 716 is not an integer multiple of the number of LEDs utilized for producing that color. For example, the illumination logic 716, which controls four sets of LEDs might receive a whole backlight illumination intensity value of 15 for the color red. The whole backlight illumination intensity value of 15 is clearly not an integer multiple of 4, which is the total number of LEDs (704R, 706R, 708R and 710R) utilized for producing the color red. As discussed below with reference to FIGS. 6A-8, in such cases, the illumination logic 716 can be configured to individually control the output of one or more of the LEDs for each color to output light with a lesser illumination level for at least a portion of an illumination period. However, the LEDs are illuminated such that the light output by the backlight 700 is still substantially uniform across the display.

In some implementations, the illumination period can correspond to the time for which an image subfield is to be displayed. In some other implementations, such as the ones that employ time division gray-scale, the illumination period can correspond to the amount of time a subframe is illuminated. In some other implementations, the illumination period can correspond to other time periods relevant to the display of images.

The operation of the backlight 700 described above is different from "local dimming" employed in certain existing displays. In local dimming, a backlight is divided into a plurality of regions, each of which is illuminated by one or more light sources. The illumination intensity of each of the light sources is determined based on the image content being displayed in the corresponding region. Thus, for a backlight employing local dimming, the backlight would receive separate illumination level signals (digital or analog) for each region without particular regard to the total illumination level of the backlight as a whole. In contrast, as described above, the illumination logic 716 of the backlight 700 receives a whole backlight illumination intensity value. Moreover, the selection of which of the LEDs in the LED sets 704, 706, 708 and 710 are illuminated at a different intensity level is independent of the image content associated with regions of the display adjacent the LEDs, such that a viewer perceives a different illumination level in that region, as is done with local dimming. Instead, the LEDs are driven in a way that results in a substantially uniform output of light across the surface of the backlight 700 such that a viewer is unable to perceive the differences in LED outputs.

FIGS. 6A-8 show example backlight illumination timing diagrams. Each Figure shows a different way in which the illumination logic 716 shown in FIG. 5 can control the LEDs to generate a total illumination intensity level equal to a desired whole backlight illumination intensity value when the value is not equal to an integer multiple of the number of independently controlled LEDs in the backlight 700.

Figure 6A:
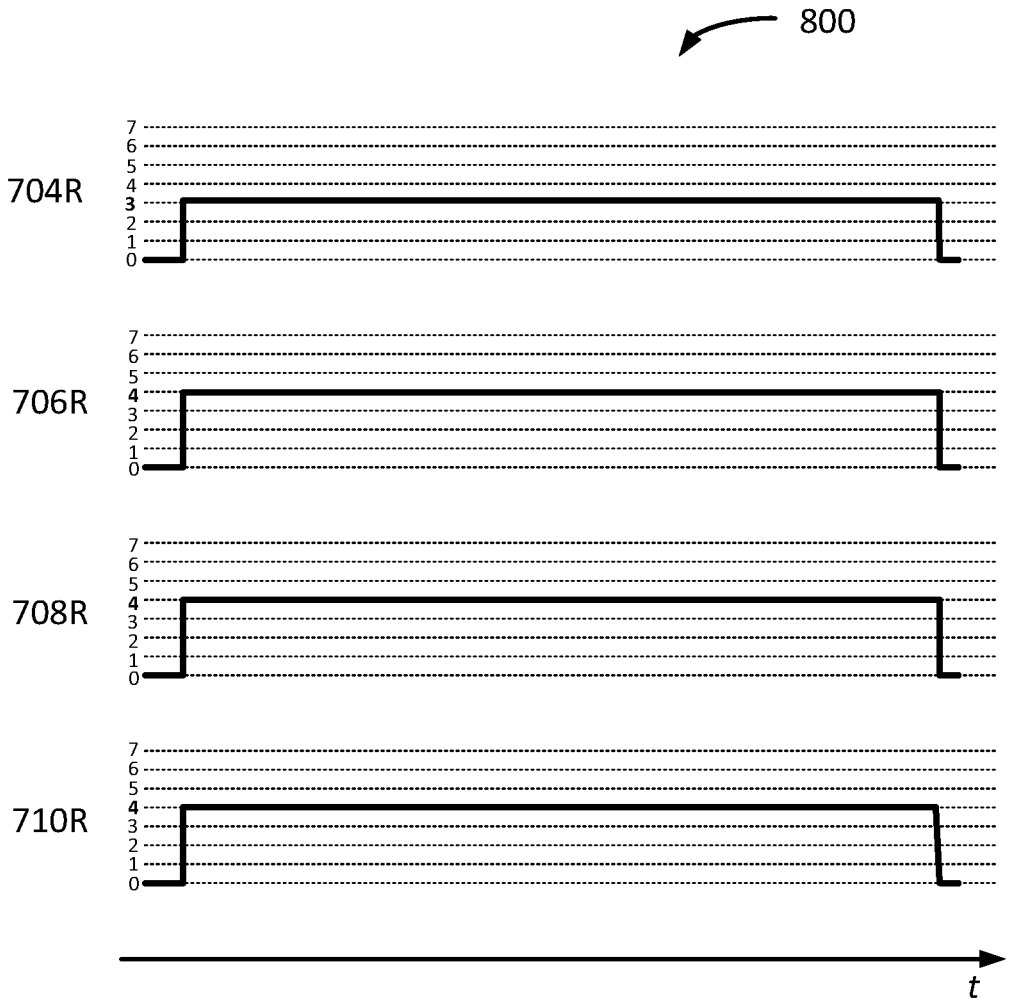
FIGS. 6A-8 show example backlight illumination timing diagrams.

FIG. 6A shows a first example timing diagram 800 illustrating a first technique for a backlight 700 to generate the total illumination intensity level equal to the desired whole backlight illumination intensity value for a color when the value is not an integer multiple of the number of independently controlled LEDs of that color. In the first technique, the illumination logic 716 selects one or more LEDs to illuminate at a lower illumination intensity level than a remainder of the LEDs for the entirety of an illumination period.

Specifically, the first example timing diagram 800 shows example illumination levels generated by the four red LEDs 704R, 706R, 708R and 710R in response to the illumination logic 716 receiving a whole backlight illumination intensity value of 15 for the color red. It should be understood that the whole backlight illumination intensity value of 15 is only an example, and that the illumination logic 716 may receive any other value, such as 9, 26, 35, etc. While FIG. 6A shows the timing diagrams for only the red color LEDs, a person having ordinary skill in the art will readily understand that illumination levels for LEDs of other colors based on whole backlight illumination intensity values received for those colors can be similarly generated. In various implementations, such other color LEDs may be illuminated simultaneously or sequentially with respect to the illumination of the red LEDs.

In FIG. 6A, it is assumed that each red LED 704R, 706R, 708R and 710R can generate eight discrete illumination levels, levels 0-7. However, in some other implementations, the LEDs can generate different number of illumination levels such as 2, 4, 16, 32, etc. The number of illumination levels generated by the LEDs can be based on the number of discrete levels output by the corresponding DAC. For example, in some implementations, the number of discrete levels output by an n-bit DAC is equal to $2^n$, where n corresponds to the number of bit resolution of the DAC. Therefore, a 1, 2, 3, 4 or 5-bit DAC can allow the LEDs to generate 2, 4, 8, 16 or 32 illumination levels, respectively.

As mentioned above, the received whole backlight illumination intensity value for the color red is equal to 15. This means that the sum of illumination levels of all the four red LEDs 704R, 706R, 708R and 710R should be equal to the 15. As the LEDs can only achieve the eight aforementioned discrete illumination levels, i.e., 0-7, if all four LEDs 704R, 706R, 708R and 710R were to generate the same illumination level, then the sum of the illumination levels of all the four LEDs 704R, 706R, 708R and 710R would never be equal to 15. At best, the backlight 700 could achieve a total output intensity level of 12 or 16. Therefore, the illumination logic 716 controls the illumination levels of each of the four LEDs 704R, 706R, 708R and 710R individually to different illumination levels such that the sum of their illumination levels is equal to the whole backlight illumination intensity value of 15.

Accordingly, as shown in FIG. 6A, the illumination logic 716 causes one LED, in this case the first red LED 704R, to be illuminated at an illumination level of 3 for the entirety of an illumination period and causes the other three LEDs 706R, 708R and 710R to be illuminated at the illumination level of 4 for the same illumination period. Thus, the sum of the illumination levels of the four LEDs 704R, 706R, 708R and 710R is equal to 15, which is the desired whole backlight illumination intensity value received by the illumination logic 716. In this manner, by individually controlling the illumination levels of the four LEDs, the desired sum of illumination levels can be achieved. It should be noted that the individual illumination levels shown in 6A to achieve the desired sum of 15 is only an example, and that other individual illumination levels to achieve the same sum of 15 also can be used.

Figure 6B:
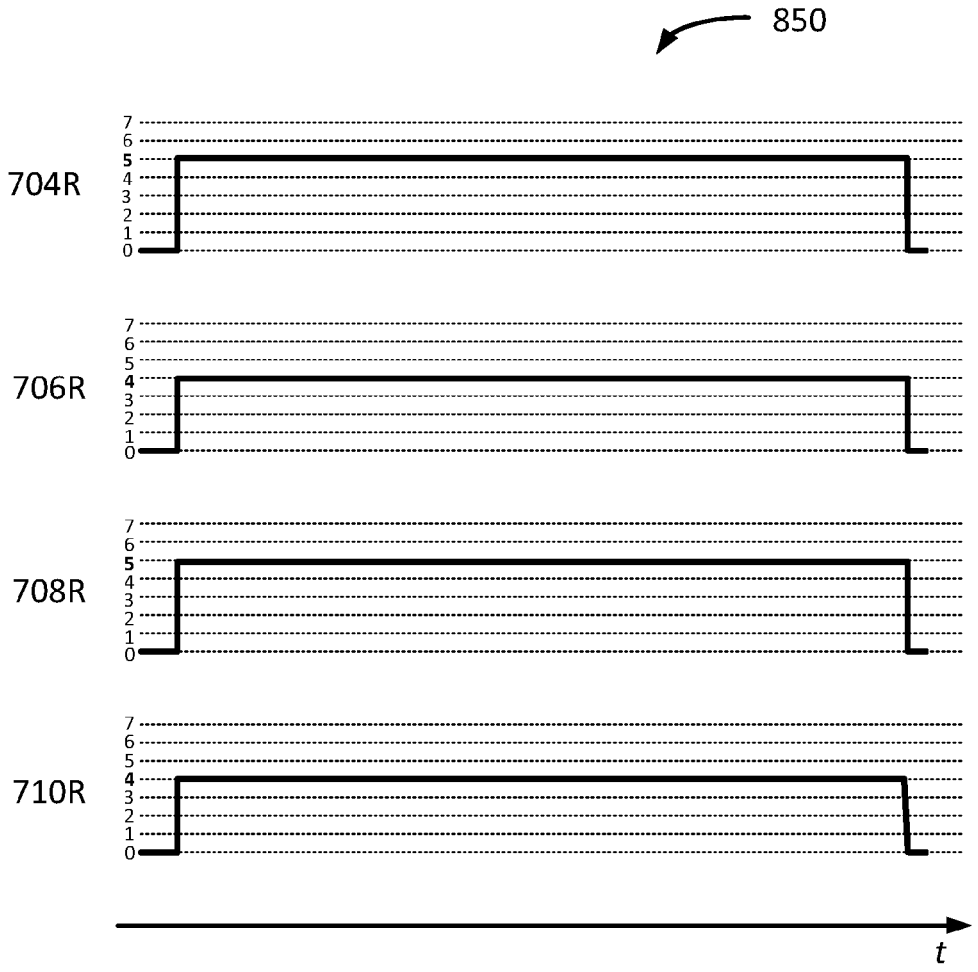

FIG. 6B shows another example backlight illumination timing diagram 850. The timing diagram 850 illustrates another application of the same technique shown in FIG. 6A for a backlight 700 to achieve a total illumination intensity level that is substantially equal to the desired whole backlight illumination level for a color when the value is not an integer multiple of the number of LEDs of that color. In particular, the timing diagram shows illumination levels of the four red LEDs 704R, 706R, 708R and 710R in response to a whole backlight illumination intensity value of 18. In contrast to the generation of a total illumination intensity level of 15, shown in FIG. 6A, which is only 1 discrete illumination level from an integer multiple of the number of red LEDs in the backlight 700, a whole backlight illumination value of 18 is two discrete illumination levels from an integer multiple of the number of red LEDs in the backlight 700. Accordingly, the illumination logic 716 causes two LEDs, in this case LEDs 706R and 710R to be illuminated at a lower illumination level than the remainder of the LEDs. Specifically, the LEDs 706R and 710R are illuminated to an illumination level of 4 and the other two LEDs 704R and 708R are illuminated to an illumination level of 5. Thus, the sum of the illumination levels of the four LEDs 704R, 706R, 708R and 710R is equal to 18, which is the desired whole backlight illumination intensity value received by the illumination logic 716. It should be noted that the illumination logic 716 can select a different set of two LEDs, out of the four LEDs 704R, 706R, 708R and 710R, to be illuminated at a lower illumination level. For example, the illumination logic may select the LEDs 704R and 710R, instead of LEDs 706R and 710R (as shown in FIG. 6B) to be illuminated at a lower illumination level of 4. The remaining LEDs 706R and 708R would then be selected to be illuminated at the higher illumination level of 5.

In some implementations, the difference between the illumination levels of any two LEDs of the same color is limited to a certain number. For example, as shown in FIG. 6A, the individual illumination levels of the four LEDs 704R, 706R, 708R and 710R is 4, 4, 4, and 3, respectively. This means that the difference between the any two illumination levels is no more than 1. The maximum difference can be a function of the resolution of the DAC. For backlights including higher resolution DACs, yielding more closely spaced discrete illumination levels, the maximum difference in illumination levels between LEDs can be greater than 1. Large differences in the illumination levels may result in non-uniform illumination across the backlight 700 that may be perceptible by a viewer. Therefore, appropriate illumination levels can be selected to promote uniformity of illumination across the surface of the backlight 700.

Figure 7A:
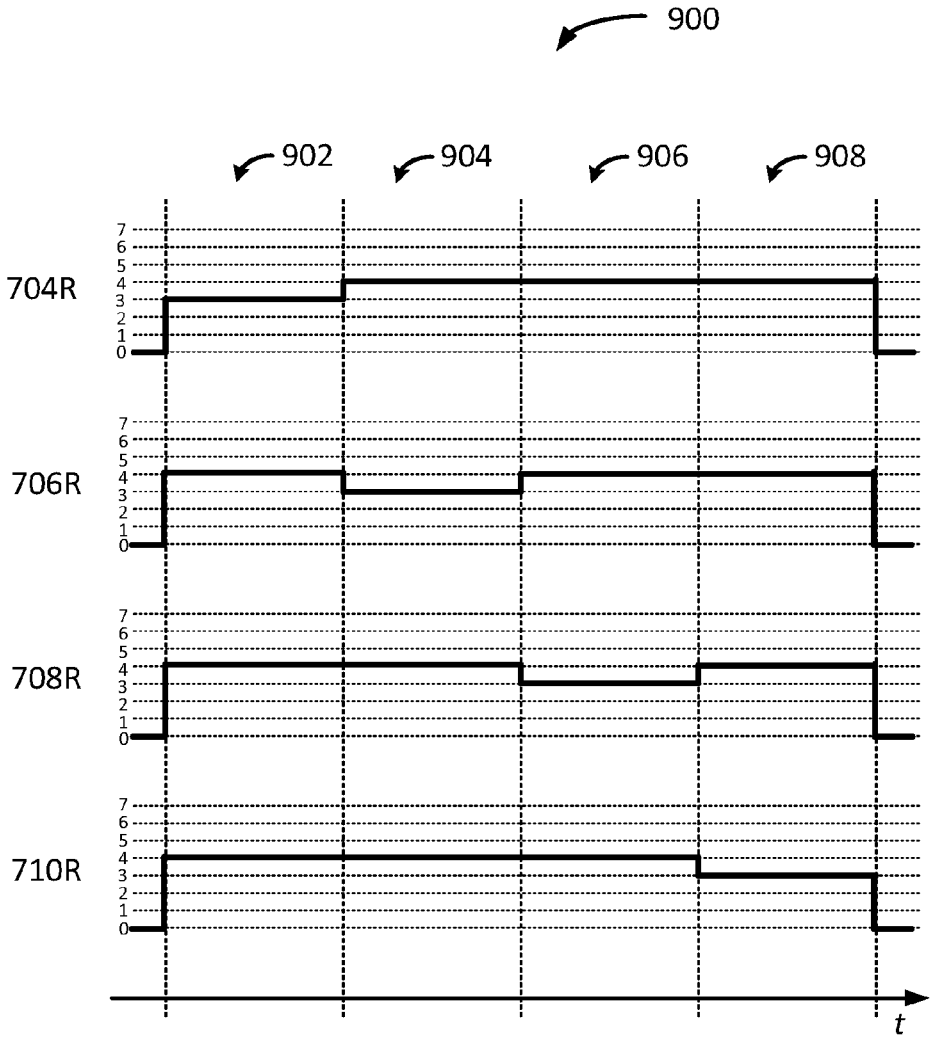

FIG. 7A shows a third example backlight illumination timing diagram 900 illustrating a second technique of backlight illumination when the whole backlight illumination intensity value for a color is not a integer multiple of the number of independently controlled LEDs for that color. Similar to the first technique shown in FIG. 6A, in the second technique the illumination logic 716 selects one or more LEDs to be illuminated at a lower discrete illumination level than a remainder of the LEDs. However, unlike the first technique, in which the same LED is selected for the entire illumination period, in the second technique the selected LED is changed from one portion of the illumination period to the next.

Similar to the first technique shown in FIG. 6A, the second technique also assumes the whole backlight illumination intensity value of 15. As shown in FIG. 7A, the illumination period is divided into four portions 902, 904, 906, and 908. In the first portion 902, the illumination logic 712 illuminates LED 704R to an illumination level of 3 and illuminates LEDs 706R, 708R and 710R to an illumination level of 4. Thus, the sum of the illumination levels of the four LEDs 704R, 706R, 708R and 710R is equal to 15 in the first portion 902. In the subsequent second portion 904, the illumination logic 712 switches the intensity levels of LEDs 704R and 706R such that LED 704R is illuminated at an intensity level of 4 and LED 706R is illuminated at a reduced illumination level of 3. The illumination levels of LEDs 708R and 710R remain at 4.

During the second portion 904 as well, the sum of the illumination levels is still equal to 15. But, the LED that is selected to be illuminated at a lesser illumination level is changed from the first red LED 704R to the second red LED 706R.

In the third portion 906, the illumination logic 716 again switches the illumination levels of the LEDs such that LED 708R is illuminated at an illumination level of 3, while LEDs 704R, 706R and 710R are illuminated at the illumination level of 4. In the fourth portion 908, the illumination logic 716 illuminates LEDs 704R, 706R and 708R at the illumination level of 4 while illuminating LED 710R at the lesser illumination level of 3. In both the third portion 906 and the fourth portion 908, however, the sum of the illumination levels of all the LEDs is equal to 15.

Thus, from one portion of the illumination period to the next, the illumination logic 716 changes the selection of the LED that is to be illuminated at a reduced illumination level. It should be noted that despite this change, the sum of the illumination levels of the four LEDs 704R, 706R, 708R and 710R is the same in each portion, and therefore, is also same over the entire illumination period.

In some implementations, such as the second technique shown in FIG. 7A, the illumination logic 706 selects different LEDs to be illuminated at a lesser illumination in different portions of the illumination period in a deterministic manner. For example, the illumination logic 716 selects an LED in a deterministic sequence, starting with the first red LED 704 and ending with the fourth red LED 710, to be illuminated at a lesser illumination level for each of the four sequential portions of the illumination period. In some implementations, where there are more than four illumination periods, the illumination logic 716 also may repeat the sequence of LEDs selected to be illuminated at a lesser illumination level.

In some other implementations, the illumination logic 716 may randomly select one of the four LEDs 704R, 706R, 708R and 710R that is to be illuminated at a lesser illumination intensity level in each portion of the illumination period. Despite the random selection, the illumination logic 716 ensures that sum of the illumination levels of the four LEDs 704R, 706R, 708R and 710R is equal to the whole backlight illumination intensity value of 15. Thus, for example, if the illumination logic 716 selects the second red LED 706R to be illuminated at a reduced illumination level of 3 for a particular portion of the illumination period, then the illumination logic 716 ensures that the other three LEDs 704R, 708R and 710R are all illuminated at an illumination level of 4, thereby ensuring that the sum of the illumination levels of the four LEDs 704R, 706R, 708R and 710R is substantially equal to 15 for that portion of the illumination period.

Figure 7B:
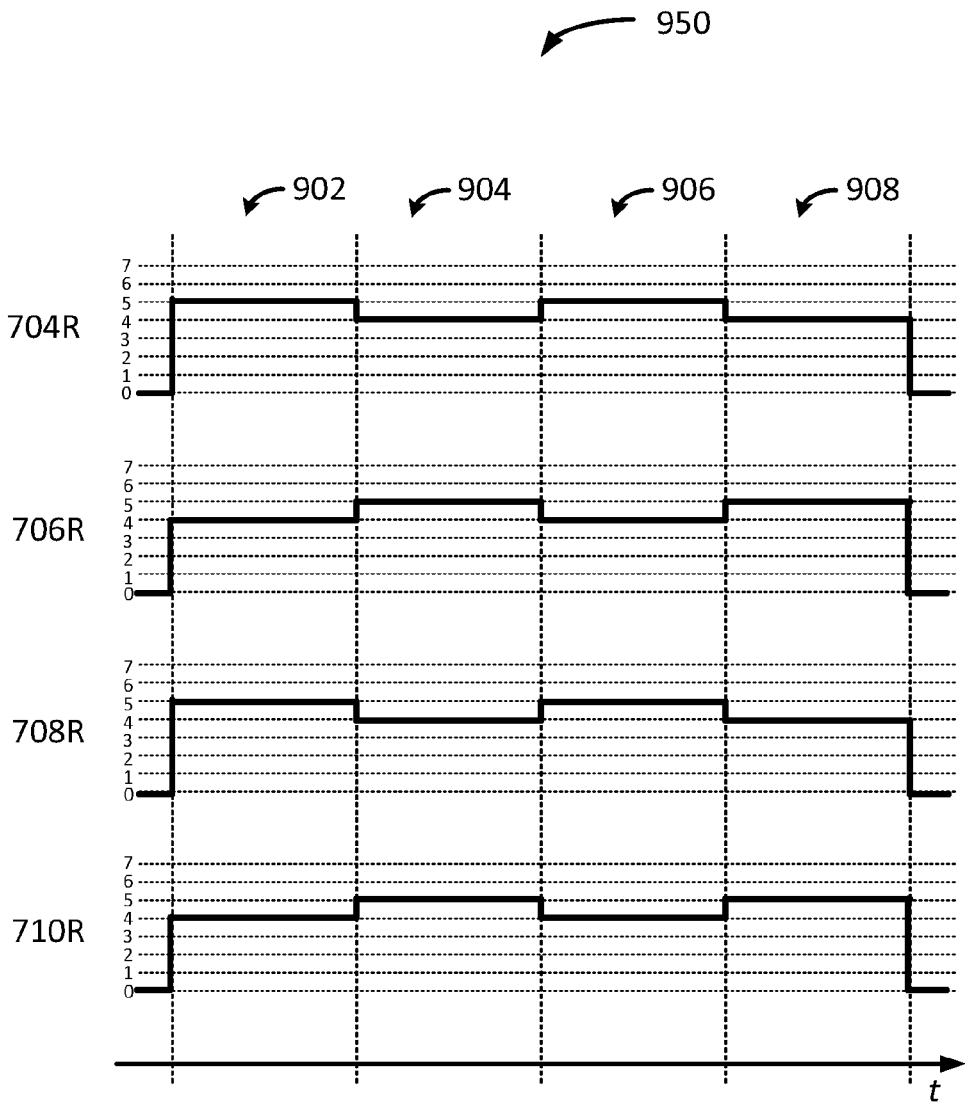

FIG. 7B shows a fourth example backlight illumination timing diagram 950. The timing diagram 950 illustrates another application of the same technique shown in FIG. 7A for a backlight 700 to achieve a total illumination intensity level that is substantially equal to the desired whole backlight illumination intensity value for a color when the value is not a integer multiple of the number of independently controlled LEDs for that color. In particular, the timing diagram shows illumination levels of the four LEDs 704R, 706R, 708R and 710R in response to a whole backlight illumination intensity value of 18.

The technique shown in FIG. 7B is similar to the technique shown in FIG. 6B in that the whole backlight illumination intensity value is also equal to 18, i.e., two discrete illumination levels from the nearest integer multiple of the number of red LEDs. The technique shown in 7B is also similar to the second technique shown in FIG. 7A in that the illumination logic 716 changes LEDs selected to be illuminated at a lesser illumination level from one portion of the illumination period to the next. However, while the second technique shown in FIG. 7A selects only one LED to be illuminated at a lesser illumination level, the technique shown in 7B, because the whole backlight illumination value is two discrete illumination levels away from an integer multiple of the number of independently controlled LEDs, selects two LEDs to be illuminated at a lesser illumination level per portion of the illumination period.

In the first portion 902 of the illumination period, two LEDs 704R and 708R are both illuminated at an illumination level of 5 while LEDs 706R and 710R are illuminated at a lesser illumination level of 4. The sum of the illumination levels of the four LEDs 704R, 706R, 708R and 710R is equal to the desired whole backlight illumination intensity value of 18. In the second portion 904, the illumination logic 716 switches the illumination levels of all the LEDs such that LEDs 704R and 708R are illuminated at a lower illumination level of 4 while LEDs 706R and 710R are illuminated at a higher illumination level of 5. Despite the switching in illumination levels, the sum of the illumination levels of the four LEDs 704R, 706R, 708R and 710R is maintained at 18. In the following third portion 906, the illumination logic 716 again switches the illumination levels of all the LEDs such that the illumination levels of the LEDs are similar to the corresponding illumination levels in the first portion 902. Finally, in the fourth portion 908, the illumination logic 716 again switches the illumination levels of the LEDs such that the illumination levels of the LEDs are similar to the corresponding illumination levels in the second portion 904.

In this manner, a first group of LEDs is illuminated at a lower illumination level than that of a second group of LEDs in one portion of the illumination period. Then, a different group of LEDs is illuminated at the lower illumination level in another portion. Repeatedly carrying out this process promotes uniformity of illumination across the surface of the backlight 700 ( 5).

Figure 8:
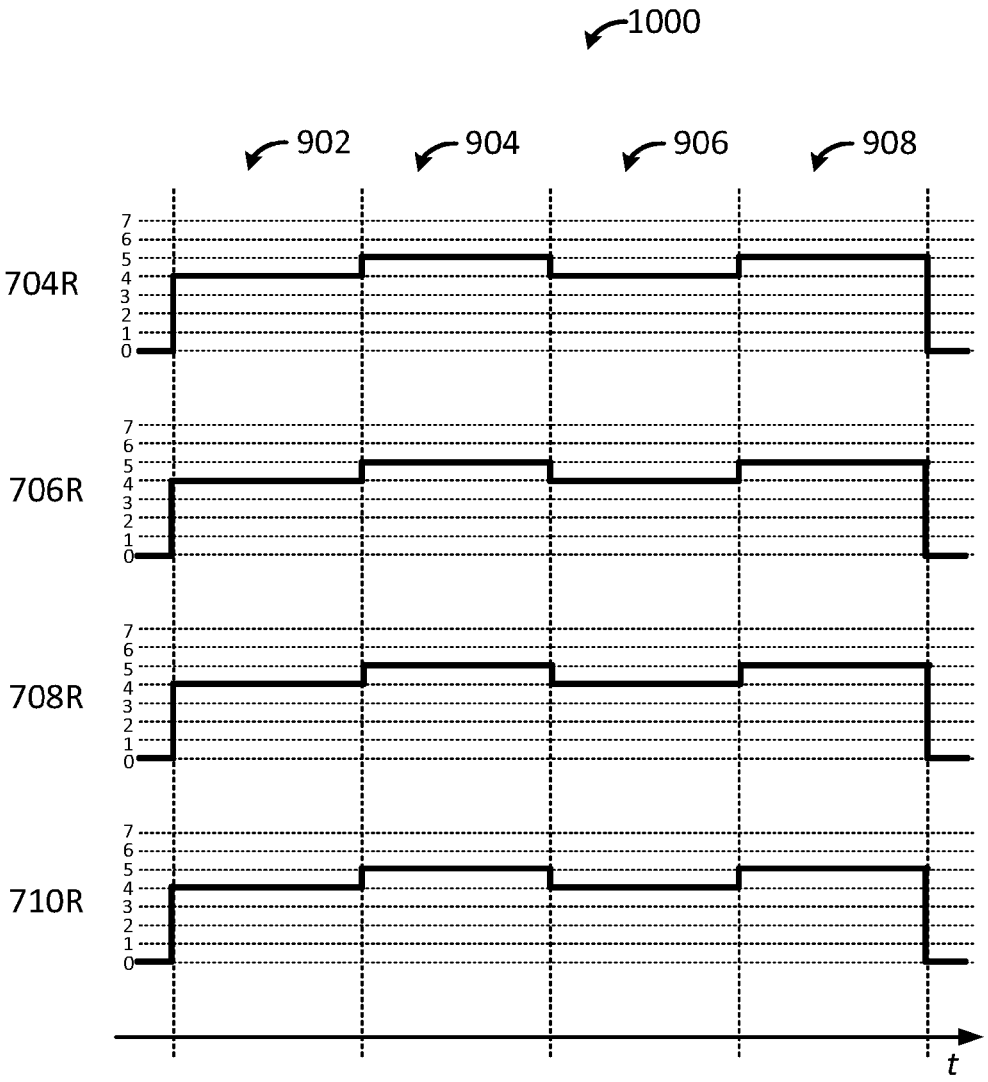

FIG. 8 shows a fifth example backlight illumination timing diagram 1000 illustrating a third technique of backlight illumination when the whole backlight illumination intensity value for a color is not a integer multiple of the number of LEDs for that color. Similar to the techniques shown in FIGS. 6B and 7B, the third technique also assumes a whole backlight illumination intensity value of 18. But in contrast with the techniques shown in FIGS. 6B and 7B, the illumination levels of the four LEDs 704R, 706R, 708R and 710R are not different in any given portion of the illumination period. In other words, the illumination logic 716, at any given time, illuminates all four of the LEDs 704R, 706R, 708R and 710R at the same illumination level. However, their illumination levels are switched from one portion of the illumination period to another such that the average of the sum of the illumination levels of the four LEDs over the entire illumination period is equal to the desired whole backlight illumination intensity value. For example, in the first portion 902 and the third portion 906 the sum of the illumination levels of the four LEDs is equal to 16, while in the second portion 904 and the fourth portion 908 the sum of the illumination levels of the four LEDs is equal to 20. Thus, over the four portions, i.e., over the entire illumination period, the average of the sum of the illumination levels of the four LEDs is equal to 18—the desired whole backlight illumination intensity value.

In some implementations, the selection of LEDs to be illuminated at the lesser illumination level may be based on the relative locations of the LEDs in the backlight 700. For example, the LEDs may be selected such that they are not adjacent to each other. Selecting non-adjacent LEDs to be illuminated at the lesser illumination level may further improve the uniformity of illumination across the surface of the backlight 700.

In some implementations, the illumination logic 716 can select no more than one-half of the total number of LEDs for illumination at the lesser illumination level. For example, referring to FIG. 5, the illumination logic 716 can select up to two of the four LEDs 704R, 706R, 708R and 710R for illumination at the lesser illumination level.

Figure 9:
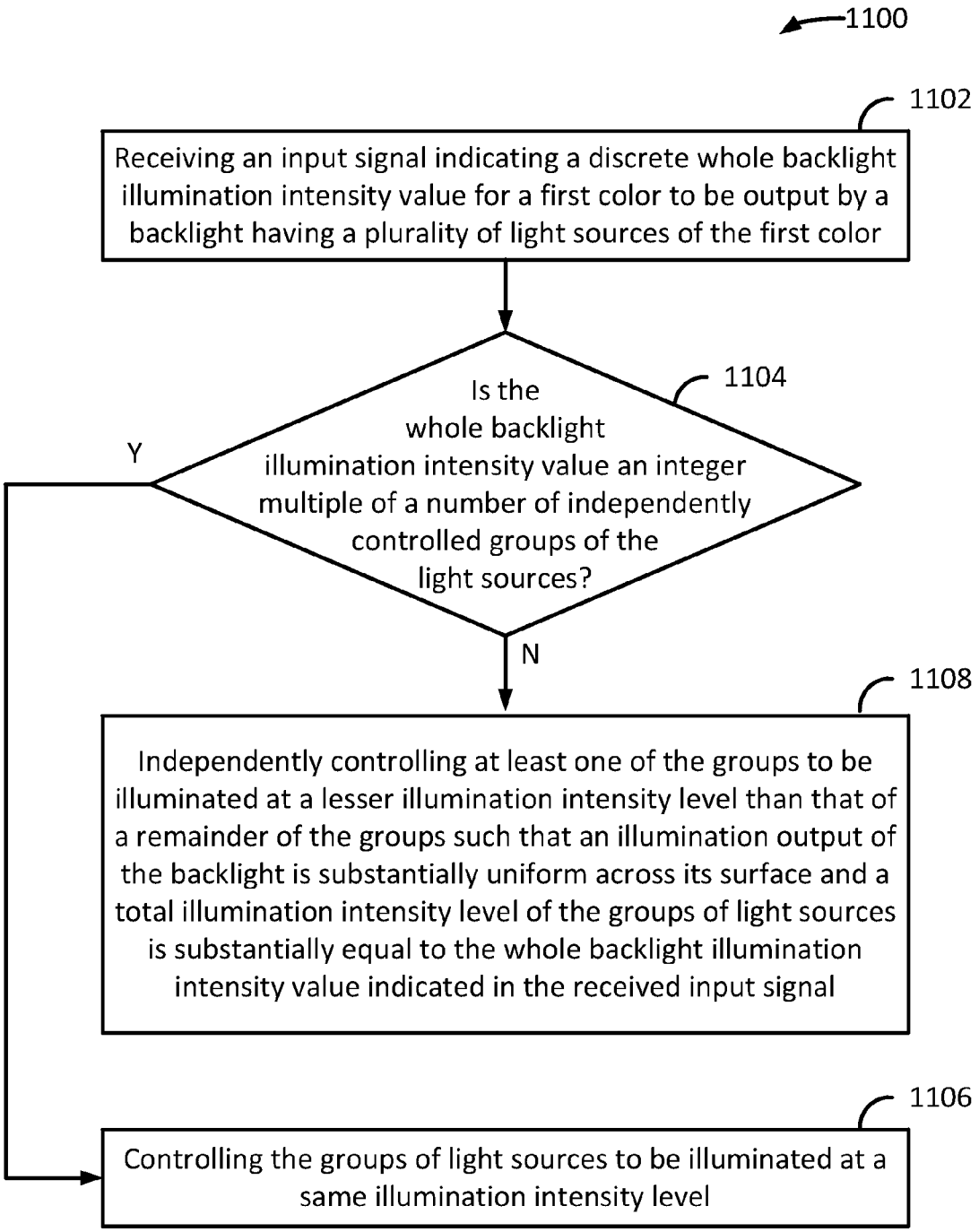
FIGS. 9-11 show example flow diagrams of processes for illuminating light sources of a backlight.
Figure 10:
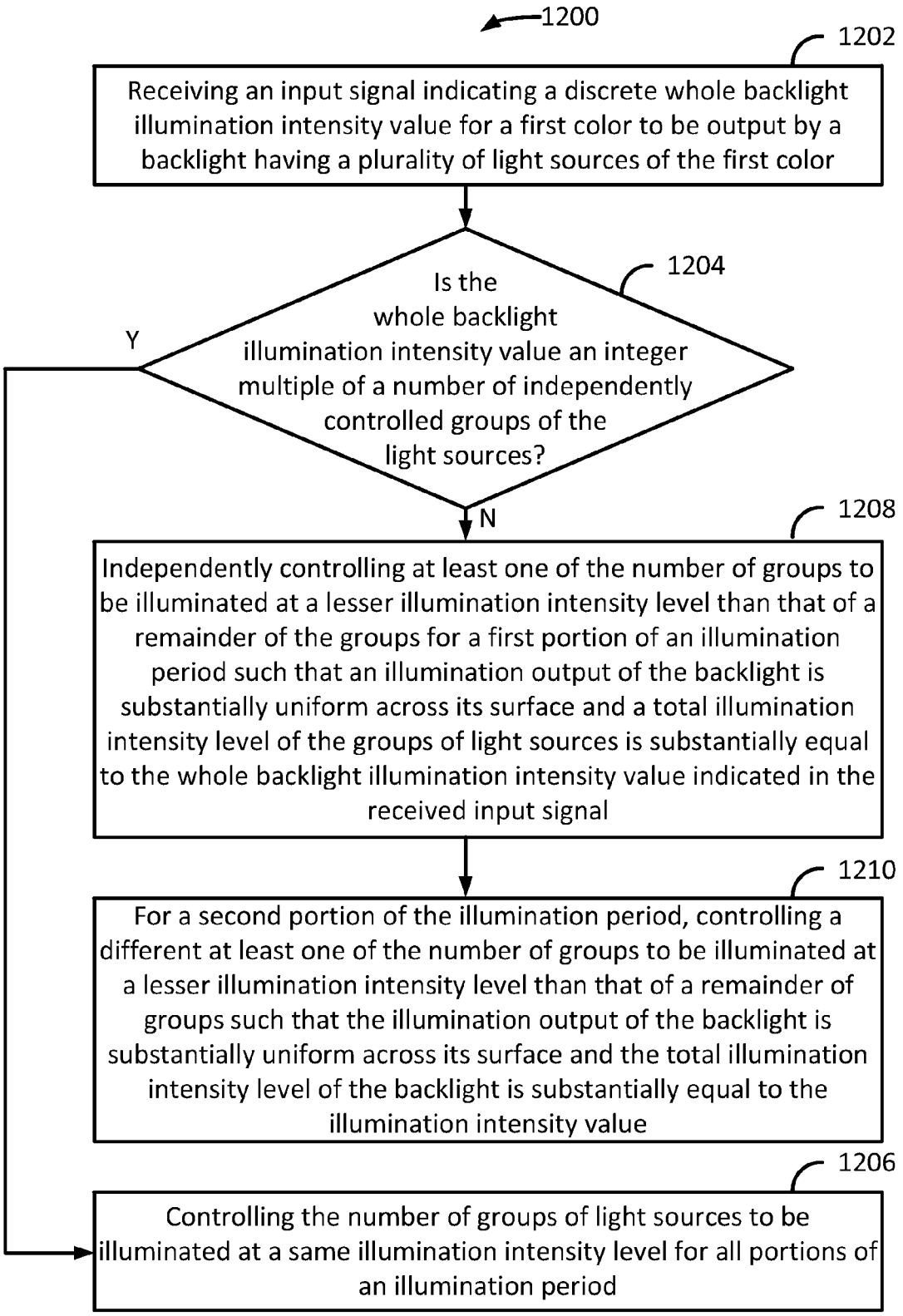
Figure 11:
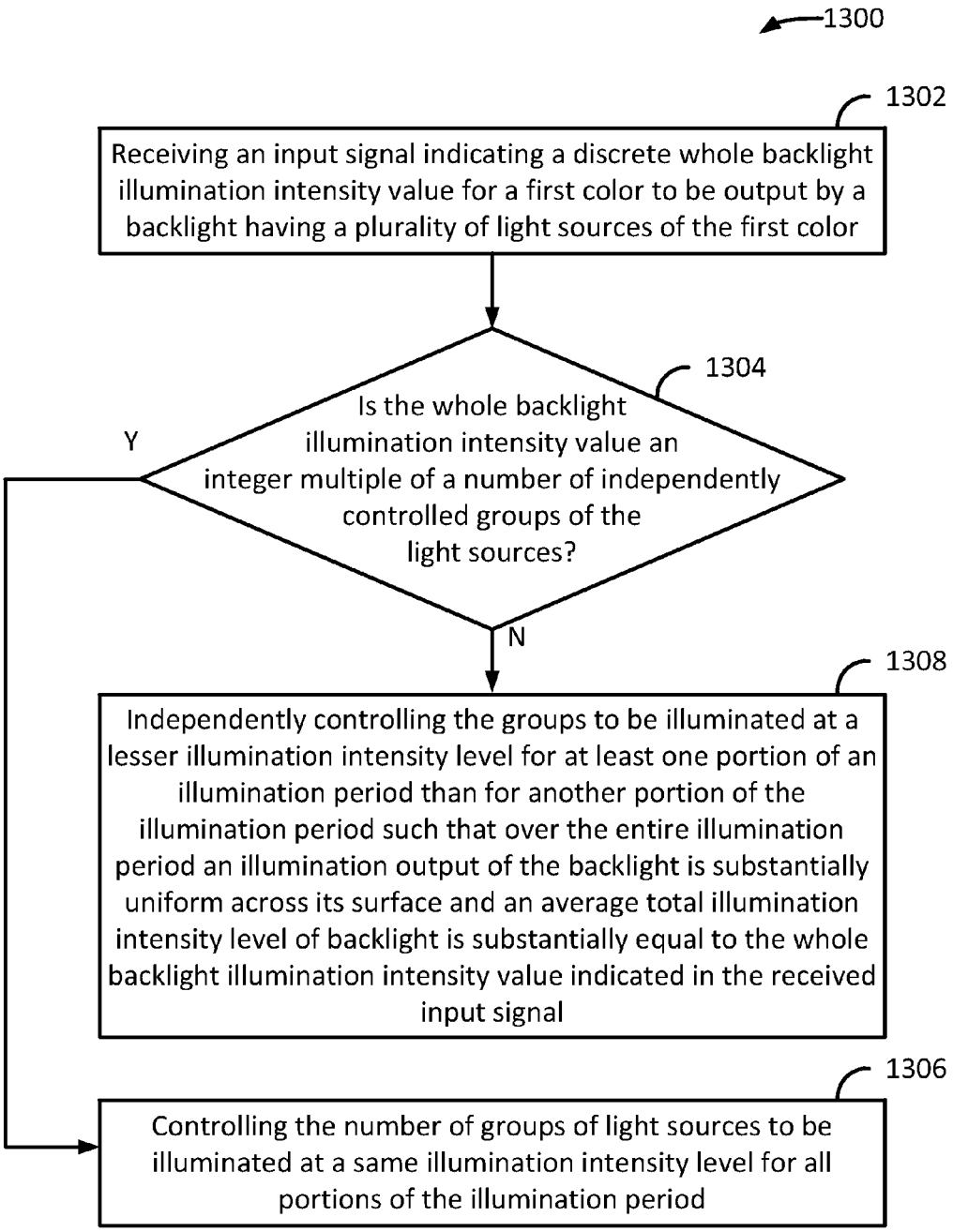

FIGS. 9-11 show example flow diagrams of processes for illuminating light sources of a backlight, such as the backlight 700 shown in FIG. 5. In particular, FIG. 9 shows a flow diagram of an example process 1100 for illuminating the backlight 700. Specifically, the process 1100 includes receiving an input signal indicating a discrete whole backlight illumination intensity value for a first color to be output by the backlight 700 having a plurality of light sources of the first color (stage 1102), determining if the whole backlight illumination intensity value is an integer multiple of a number of independently controlled groups of the light sources (stage 1104), if the whole backlight illumination intensity value is an integer multiple, then controlling the groups of light sources to be illuminated at a same illumination intensity level (stage 1106), and if the whole backlight illumination intensity value is not an integer multiple, then independently controlling at least one of the number of groups to be illuminated at a lesser illumination intensity level than that of a remainder of the groups such that an illumination output of the backlight 700 is substantially uniform across its surface and a total illumination intensity level of the groups of light sources is substantially equal to the whole backlight illumination intensity value indicated in the received input signal (stage 1108).

Referring to FIGS. 5 and 9, the process 1100 begins with receiving an input signal indicating a discrete whole backlight illumination intensity value of a first color to be output by the backlight 700 (stage 1102). With reference to FIG. 5, the input signal indicating the discrete whole backlight illumination intensity value of the first color to be output by the backlight 700 can be the input signal received by the input 714 of the backlight controller 712.

Subsequently, it is determined if the whole backlight illumination intensity value is an integer multiple of a number of independently controlled groups of the light sources in the backlight 700 (stage 1104). This determination can be made by, for example, the illumination logic 716 of FIG. 5. If it is determined that the whole backlight illumination intensity value is an integer multiple of the number of independently controlled groups of the light sources, then the illumination logic 716 controls the groups of light sources to be illuminated at the same illumination intensity level such that the total illumination intensity level of the groups of light sources is equal to the received whole backlight illumination intensity value (stage 1106).

If, however, the received whole backlight illumination intensity value is not an integer multiple of a number of independently controlled groups of the light sources, the method 1100 includes controlling at least one of the groups to be illuminated at a lesser illumination intensity level than that of a remainder of the groups (stage 1108). This can be seen in FIG. 6A, in which the illumination intensity level (3) of the first red light source 704R is less than the illumination intensity levels (4) of the remaining three red light sources 706R, 708R and 710R.

The illumination intensities of the groups of the light sources are controlled such that the output of the backlight 700 is substantially uniform across its surface and a total illumination intensity level of the number of groups is substantially equal to the whole backlight illumination intensity value indicated in the received input signal (stage 1108). Referring again to FIG. 6A, by keeping the difference between the illumination intensity level of the first red light source 704R and the remaining red light sources 706R, 708R and 710R to no more than one, the distribution of light across the surface of the backlight 700 is substantially uniform. Furthermore, the total illumination intensity level of all the four red light sources 704R, 706R, 708R and 710R is equal to 15, which is the whole backlight illumination intensity value received by the backlight controller 712.

FIG. 10 shows a flow diagram of an example process 1200 for illuminating a backlight, such as the backlight 700 shown in FIG. 5. In particular, the process 1200 includes receiving an input signal indicating a discrete whole backlight illumination intensity value for a first color to be output by the backlight 700 having a plurality of light sources of the first color (stage 1202), determining if the whole backlight illumination intensity value is an integer multiple of a number of independently controlled groups of the light sources (stage 1204), if the whole backlight illumination intensity value is an integer multiple, then controlling the groups of light sources to be illuminated at a same illumination intensity level for all portions of an illumination period (stage 1206), if the whole backlight illumination intensity value is not an integer multiple, then independently controlling at least one of the number of groups to be illuminated at a lesser illumination intensity level than that of a remainder of the groups for a first portion of the illumination period such that an illumination output of the backlight 700 is substantially uniform across its surface and a total illumination intensity level of the groups of light sources is substantially equal to the whole backlight illumination intensity value indicated in the received input signal (stage 1208), and for a second portion of the illumination period, controlling a different at least one of the number of groups to be illuminated at a lesser illumination intensity level than that of a remainder of the groups such that the illumination output of the backlight 700 is substantially uniform across its surface and the total illumination intensity level of the groups of light sources is substantially equal to the whole backlight illumination intensity value (stage 1210).

The process 1200 of FIG. 10 is similar to the process 1100 of FIG. 9 except that the illumination intensity levels of the groups of light sources are varied over multiple portions within an illumination period. For example, the at least one of the number of group of light sources is illuminated at an illumination intensity level that is less than that of the remainder of the groups of light sources for a first portion (stage 1204). This was discussed above, for example, in relation to FIG. 7B, in which the illumination intensity levels of the second and fourth LEDs, 706R and 710R, are less than the illumination intensity levels of the first and third LEDs, 704R and 708R for the first portion 902. For a second portion of the illumination period, the illumination levels are switched such that a different at least one of the group of light sources is illuminated at an illumination level that is less than that of a remainder of the groups while maintaining the total illumination level to be substantially equal to the received whole backlight illumination intensity value (stage 1210). Referring again to FIG. 7B, the illumination levels of the first and third LEDs, 704R and 708R, are switched to be less than the illumination levels of the second and fourth LEDs, 706R and 710R for the portion 904, while maintaining the total illumination level of all the LEDs to be equal to the desired whole backlight illumination intensity value of 18.

FIG. 11 shows a flow diagram of an example process 1300 for illuminating a backlight 700. In particular, the process 1300 includes receiving an input signal indicating a discrete whole backlight illumination intensity value for a first color to be output by the backlight 700 having a plurality of light sources of the first color (stage 1302), determining if the whole backlight illumination intensity value is an integer multiple of a number of independently controlled groups of the light sources (stage 1304), if the whole backlight illumination intensity value is an integer multiple, then controlling the number of groups of light sources to be illuminated at a same illumination intensity level for all portions of an illumination period (stage 1306), and if the whole backlight illumination intensity value is not an integer multiple of the number of independently controlled groups of the light sources, independently controlling the groups to be illuminated at a lesser illumination intensity level for at least one portion of an illumination period than for another portion of the illumination period such that over the entire illumination period an illumination output of the backlight 700 is substantially uniform across its surface and an average total illumination intensity level of the number of groups is substantially equal to the whole backlight illumination intensity value indicated in the received input signal (stage 1308).

In the process 1300 of FIG. 11, the illumination intensity levels of all the groups of light sources are switched from one portion of the illumination period to the next such that in one portion the intensity levels are lesser than that in another portion. For example, referring to 8, all four of the LEDs 704R, 706R, 708R and 710R are at an illumination intensity level of 4 for the first and third portions, 902 and 906. In the other two portions 904 and 908, the illumination intensity levels of all four of the LEDs 704R, 706R, 708R and 710R are switched to an illumination intensity level of 5. However, for the entire illumination period, the average total illumination intensity level of the four LEDs 704R, 706R, 708R and 710R is equal to the desired whole backlight illumination intensity value of 18.

While the techniques described above with reference to FIGS. 6A-11 mention operating one of more LEDs at a lesser illumination level, it is understood that the same techniques can be viewed as operating the remainder of the LEDs at a higher illumination level.

Figure 12A:
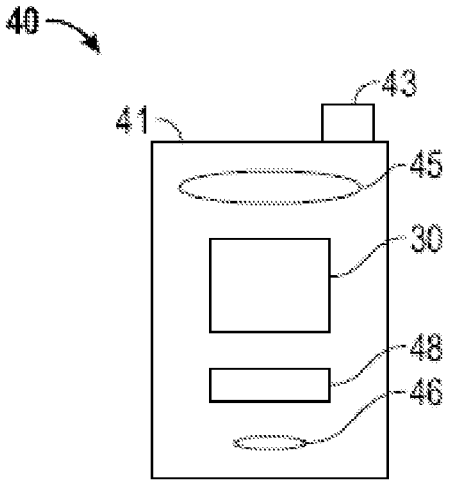
FIGS. 12A and 12B are system block diagrams illustrating an example display device that includes a plurality of display elements.
Figure 12B:
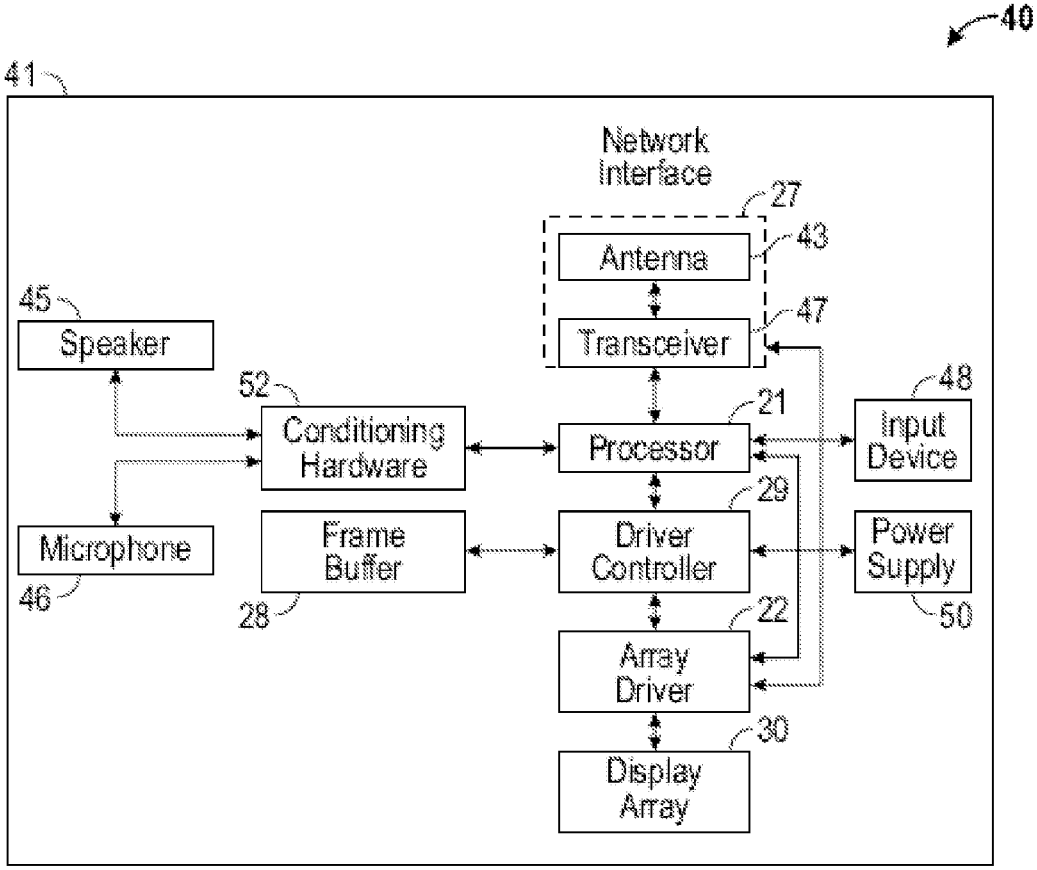

FIGS. 12A and 12B are system block diagrams illustrating a display device 40 that includes a plurality of display elements. The display device 40 can be, for example, a smart phone, a cellular or mobile telephone. However, the same components of the display device 40 or slight variations thereof are also illustrative of various types of display devices such as televisions, computers, tablets, e-readers, hand-held devices and portable media devices.

The display device 40 includes a housing 41, a display 30, an antenna 43, a speaker 45, an input device 48 and a microphone 46. The housing 41 can be formed from any of a variety of manufacturing processes, including injection molding, and vacuum forming. In addition, the housing 41 may be made from any of a variety of materials, including, but not limited to: plastic, metal, glass, rubber and ceramic, or a combination thereof. The housing 41 can include removable portions (not shown) that may be interchanged with other removable portions of different color, or containing different logos, pictures, or symbols.

The display 30 may be any of a variety of displays, including a bi-stable or analog display, as described herein. The display 30 also can be configured to include a flat-panel display, such as plasma, electroluminescent (EL) displays, OLED, super twisted nematic (STN) display, LCD, or thin-film transistor (TFT) LCD, or a non-flat-panel display, such as a cathode ray tube (CRT) or other tube device. In addition, the display 30 can include a mechanical light modulator-based display, as described herein.

The components of the display device 40 are schematically illustrated in FIG. 12B. The display device 40 includes a housing 41 and can include additional components at least partially enclosed therein. For example, the display device 40 includes a network interface 27 that includes an antenna 43 which can be coupled to a transceiver 47. The network interface 27 may be a source for image data that could be displayed on the display device 40. Accordingly, the network interface 27 is one example of an image source module, but the processor 21 and the input device 48 also may serve as an image source module. The transceiver 47 is connected to a processor 21, which is connected to conditioning hardware 52. The conditioning hardware 52 may be configured to condition a signal (such as filter or otherwise manipulate a signal). The conditioning hardware 52 can be connected to a speaker 45 and a microphone 46. The processor 21 also can be connected to an input device 48 and a driver controller 29. The driver controller 29 can be coupled to a frame buffer 28, and to an array driver 22, which in turn can be coupled to a display array 30. One or more elements in the display device 40, including elements not specifically depicted in FIG. 12A, can be configured to function as a memory device and be configured to communicate with the processor 21. In some implementations, a power supply 50 can provide power to substantially all components in the particular display device 40 design.

The network interface 27 includes the antenna 43 and the transceiver 47 so that the display device 40 can communicate with one or more devices over a network. The network interface 27 also may have some processing capabilities to relieve, for example, data processing requirements of the processor 21. The antenna 43 can transmit and receive signals. In some implementations, the antenna 43 transmits and receives RF signals according to the IEEE 16.11 standard, including IEEE 16.11(a), (b), or (g), or the IEEE 802.11 standard, including IEEE 802.11a, b, g, n, and further implementations thereof. In some other implementations, the antenna 43 transmits and receives RF signals according to the Bluetooth® standard. In the case of a cellular telephone, the antenna 43 can be designed to receive code division multiple access (CDMA), frequency division multiple access (FDMA), time division multiple access (TDMA), Global System for Mobile communications (GSM), GSM/General Packet Radio Service (GPRS), Enhanced Data GSM Environment (EDGE), Terrestrial Trunked Radio (TETRA), Wideband-CDMA (W-CDMA), Evolution Data Optimized (EV-DO), 1xEV-DO, EV-DO Rev A, EV-DO Rev B, High Speed Packet Access (HSPA), High Speed Downlink Packet Access (HSDPA), High Speed Uplink Packet Access (HSUPA), Evolved High Speed Packet Access (HSPA+), Long Term Evolution (LTE), AMPS, or other known signals that are used to communicate within a wireless network, such as a system utilizing 3G, 4G or 5G technology. The transceiver 47 can preprocess the signals received from the antenna 43 so that they may be received by and further manipulated by the processor 21. The transceiver 47 also can process signals received from the processor 21 so that they may be transmitted from the display device 40 via the antenna 43.

In some implementations, the transceiver 47 can be replaced by a receiver. In addition, in some implementations, the network interface 27 can be replaced by an image source, which can store or generate image data to be sent to the processor 21. The processor 21 can control the overall operation of the display device 40. The processor 21 receives data, such as compressed image data from the network interface 27 or an image source, and processes the data into raw image data or into a format that can be readily processed into raw image data. The processor 21 can send the processed data to the driver controller 29 or to the frame buffer 28 for storage. Raw data typically refers to the information that identifies the image characteristics at each location within an image. For example, such image characteristics can include color, saturation and gray-scale level.

The processor 21 can include a microcontroller, CPU, or logic unit to control operation of the display device 40. The conditioning hardware 52 may include amplifiers and filters for transmitting signals to the speaker 45, and for receiving signals from the microphone 46. The conditioning hardware 52 may be discrete components within the display device 40, or may be incorporated within the processor 21 or other components.

The driver controller 29 can take the raw image data generated by the processor 21 either directly from the processor 21 or from the frame buffer 28 and can re-format the raw image data appropriately for high speed transmission to the array driver 22. In some implementations, the driver controller 29 can re-format the raw image data into a data flow having a raster-like format, such that it has a time order suitable for scanning across the display array 30. Then the driver controller 29 sends the formatted information to the array driver 22. Although a driver controller 29, such as an LCD controller, is often associated with the system processor 21 as a stand-alone Integrated Circuit (IC), such controllers may be implemented in many ways. For example, controllers may be embedded in the processor 21 as hardware, embedded in the processor 21 as software, or fully integrated in hardware with the array driver 22.

The array driver 22 can receive the formatted information from the driver controller 29 and can re-format the video data into a parallel set of waveforms that are applied many times per second to the hundreds, and sometimes thousands (or more), of leads coming from the display's x-y matrix of display elements. In some implementations, the array driver 22 and the display array 30 are a part of a display module. In some implementations, the driver controller 29, the array driver 22, and the display array 30 are a part of the display module.

In some implementations, the driver controller 29, the array driver 22, and the display array 30 are appropriate for any of the types of displays described herein. For example, the driver controller 29 can be a conventional display controller or a bi-stable display controller (such as a mechanical light modulator display element controller). Additionally, the array driver 22 can be a conventional driver or a bi-stable display driver (such as a mechanical light modulator display element controller). Moreover, the display array 30 can be a conventional display array or a bi-stable display array (such as a display including an array of mechanical light modulator display elements). In some implementations, the driver controller 29 can be integrated with the array driver 22. Such an implementation can be useful in highly integrated systems, for example, mobile phones, portable-electronic devices, watches or small-area displays.

In some implementations, the input device 48 can be configured to allow, for example, a user to control the operation of the display device 40. The input device 48 can include a keypad, such as a QWERTY keyboard or a telephone keypad, a button, a switch, a rocker, a touch-sensitive screen, a touch-sensitive screen integrated with the display array 30, or a pressure- or heat-sensitive membrane. The microphone 46 can be configured as an input device for the display device 40. In some implementations, voice commands through the microphone 46 can be used for controlling operations of the display device 40.

The power supply 50 can include a variety of energy storage devices. For example, the power supply 50 can be a rechargeable battery, such as a nickel-cadmium battery or a lithium-ion battery. In implementations using a rechargeable battery, the rechargeable battery may be chargeable using power coming from, for example, a wall socket or a photovoltaic device or array. Alternatively, the rechargeable battery can be wirelessly chargeable. The power supply 50 also can be a renewable energy source, a capacitor, or a solar cell, including a plastic solar cell or solar-cell paint. The power supply 50 also can be configured to receive power from a wall outlet.

In some implementations, control programmability resides in the driver controller 29 which can be located in several places in the electronic display system. In some other implementations, control programmability resides in the array driver 22. The above-described optimization may be implemented in any number of hardware and/or software components and in various configurations.

The various illustrative logics, logical blocks, modules, circuits and algorithm processes described in connection with the implementations disclosed herein may be implemented as electronic hardware, computer software, or combinations of both. The interchangeability of hardware and software has been described generally, in terms of functionality, and illustrated in the various illustrative components, blocks, modules, circuits and processes described above. Whether such functionality is implemented in hardware or software depends upon the particular application and design constraints imposed on the overall system.

The hardware and data processing apparatus used to implement the various illustrative logics, logical blocks, modules and circuits described in connection with the aspects disclosed herein may be implemented or performed with a general purpose single- or multi-chip processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, for example, a combination of a DSP and a microprocessor, a plurality of microprocessors, one or more microprocessors in conjunction with a DSP core, or any other such configuration. In some implementations, particular processes and methods may be performed by circuitry that is specific to a given function.

In one or more aspects, the functions described may be implemented in hardware, digital electronic circuitry, computer software, firmware, including the structures disclosed in this specification and their structural equivalents thereof, or in any combination thereof. Implementations of the subject matter described in this specification also can be implemented as one or more computer programs, i.e., one or more modules of computer program instructions, encoded on a computer storage media for execution by, or to control the operation of, data processing apparatus.

If implemented in software, the functions may be stored on or transmitted over as one or more instructions or code on a computer-readable medium. The processes of a method or algorithm disclosed herein may be implemented in a processor-executable software module which may reside on a computer-readable medium. Computer-readable media includes both computer storage media and communication media including any medium that can be enabled to transfer a computer program from one place to another. A storage media may be any available media that may be accessed by a computer. By way of example, and not limitation, such computer-readable media may include RAM, ROM, EEPROM, CD-ROM or other optical disk storage, magnetic disk storage or other magnetic storage devices, or any other medium that may be used to store desired program code in the form of instructions or data structures and that may be accessed by a computer. Also, any connection can be properly termed a computer-readable medium. Disk and disc, as used herein, includes compact disc (CD), laser disc, optical disc, digital versatile disc (DVD), floppy disk, and blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and instructions on a machine readable medium and computer-readable medium, which may be incorporated into a computer program product.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of any device as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

What is claimed is:

1. An apparatus, comprising:

a backlight;

a plurality of light sources associated with a first color; and illumination control logic coupled to the plurality of light sources configured to:

independently control a number of groups of the light sources to output a plurality of discrete output illumination intensity levels, receive an input signal indicating a discrete whole backlight illumination intensity value for the first color to be output by the backlight, in response to the input signal indicating a whole backlight illumination intensity value that is not an integer multiple of the number of groups, controlling at least one of the groups to be illuminated at a lesser intensity level than a remainder of the groups such that an illumination output of the backlight is substantially uniform across its surface and the total illumination intensity level of the groups of light sources is substantially equal to the whole backlight illumination intensity value indicated in the received input signal, and cause the at least one group of light sources to be illuminated at the lesser illumination intensity for less than an entirety of a period of time, and at a greater intensity for the remainder of the period of time, while maintaining the total illumination intensity level of the groups of light sources to be substantially equal to the whole backlight illumination intensity value for the period of time.

2. The apparatus of claim 1, wherein the lesser intensity level is less than the intensity level of the remainder of groups of light sources by only a single discrete illumination intensity level.

3. The apparatus of claim 1, wherein the illumination control logic is further configured to illuminate up to one-half the number of independently controlled groups of light sources at the lesser intensity level.

4. The apparatus of claim 1, wherein the illumination logic is configured, to switch the at least one group of light sources outputting the lesser illumination level to a second set of the at least one group of light sources.

5. The apparatus of claim 1, wherein the at least one group of light sources includes all of the groups of light sources.

6. The apparatus of claim 1, wherein each group of light sources includes only one light source.

7. The apparatus of claim 1, wherein the light sources comprise light emitting diodes (LEDs).

8. The apparatus of claim 1, further comprising:

a display including:

the backlight, the plurality of light sources, and illumination control logic;

a processor that is configured to communicate with the display, the processor being configured to process image data; and a memory device that is configured to communicate with the processor.

9. The apparatus of claim 8, the display further including:

a driver circuit configured to send at least one signal to the display; and a controller configured to send at least a portion of the image data to the driver circuit.

10. The apparatus of claim 9, the display further including:

an image source module configured to send the image data to the processor, wherein the image source module comprises at least one of a receiver, transceiver, and transmitter.

11. The apparatus of claim 8, the display further including:

an input device configured to receive input data and to communicate the input data to the processor.

12. A method, comprising:

receiving an input signal indicating a discrete whole backlight illumination intensity value for a first color to be output by a backlight having a plurality of light sources of the first color;

in response to receiving the input signal indicating the whole backlight illumination intensity value that is not an integer multiple of a number of independently controlled groups of the plurality of light sources, independently controlling at least one of the number of groups to be illuminated at a lesser illumination intensity level than that of a remainder of the groups such that an illumination output of the backlight is substantially uniform across its surface and a total illumination intensity level of the number of groups is substantially equal to the whole backlight illumination intensity value indicated in the received input signal;

maintaining the total illumination intensity level of the groups of light sources to be equal to the whole backlight illumination intensity value for a period of time, and controlling the at least one of the number of groups to be illuminated at the lesser illumination intensity level for less than the entirety of the period of time and at a greater intensity for the remainder of the period of time.

13. The method of claim 12, wherein the lesser intensity level is less than the intensity level of the remainder of groups of light sources by only a single discrete illumination intensity level.

14. The method of claim 12, wherein the at least one of the number of groups includes one half of the total number of groups.

15. The method of claim 12, further comprising:

switching the at least one of the number of groups outputting the lesser illumination level to a second set of at least one of the number of groups while maintaining the total illumination intensity level of the groups of light sources to be equal to the whole backlight illumination intensity value.

16. The method of claim 12, wherein the at least one of the number of groups includes all of the plurality of light sources.

17. The method of claim 12, wherein each of the number of groups includes only one light source.

18. The method of claim 12, wherein the plurality of light sources include light emitting diodes.

* * * * *